US005916222A

United States Patent [19]

Iwasaki et al.

[11] Patent Number: 5,916,222

[45] Date of Patent: Jun. 29, 1999

[54] HAND-HELD DEPILATING DEVICE WITH A PAIN MASKING STIMULATOR

[75] Inventors: Jyuzaemon Iwasaki, Nagahama; Yasuhiro Sato, Suita; Mika Asada, Osaka; Toshihiro Takeuchi; Yoshinobu Takegawa, both of Hikone; Yuko Matsumura, Hirakata, all of Japan

[73] Assignee: Matsushita Electric Works, Ltd., Osaka, Japan

[21] Appl. No.: 08/855,631

[22] Filed: May 14, 1997

[30] Foreign Application Priority Data

May 15, 1996 [JP] Japan ..... 8-120693
Feb. 25, 1997 [JP] Japan ..... 9-040330

[51] Int. Cl.[6] ..... A61B 17/50

[52] U.S. Cl. ..... 606/133; 606/133; 452/75; 452/102; 452/104

[58] Field of Search ..... 606/131, 133, 606/205–211; 452/75, 102, 104

[56] References Cited

U.S. PATENT DOCUMENTS 5,346,499 9/1994 Garenfeld et al. ..... 606/133
5,356,415 10/1994 Iwasaki et al. ..... 606/133

FOREIGN PATENT DOCUMENTS 0 348 862 1/1990 European Pat. Off. .
0 493 849 7/1992 European Pat. Off. .
0 500 075 8/1992 European Pat. Off. .
0 622 033 11/1994 European Pat. Off. .
0 671 136 9/1995 European Pat. Off. .

*Primary Examiner*—Glenn K. Dawson
*Attorney, Agent, or Firm*—Armstrong, Westerman, Hattori, McLeland & Naughton

[57] ABSTRACT

A hand-held depilating device capable of masking the pain of plucking the hairs. A plucking head has a plurality of pinching elements which arrange along a horizontal axis in a closely adjacent relation and are driven to close and open gaps between the pinching elements for pinching the hairs between the adjacent elements and release the hairs therefrom. A cycler or turning mechanism is included to cyclically move the plucking head in a direction crossing with the horizontal axis so as to define, in combination with the movement of closing and opening the pinching elements, repeated depilating cycles of introducing the hairs between the adjacent pinching elements, pinching the hairs therebetween, plucking the hairs from the skin, and releasing the hairs from between the pinching elements. Mounted to the top of the housing adjacent to the plucking head is a simulator which applies stimuli to the skin independently of the plucking head. The device includes a synchronous mechanism for synchronizing a timing of applying the stimuli with the depilating cycle. Thus, the stimuli can be made at an optimum timing or timings within the depilating cycle, thereby masking the hair plucking pain.

16 Claims, 29 Drawing Sheets

132
32
131
38
33
39
36
33
30
35
34
38
36
130
25
37
22
31
39
35
23
24
20
21
69
43
41
40
69
49
141
42
44-1
44-2
46-1
46-2
47
45
52
53
50-2
50-1
53

131E
33E
36E
30E
34E
170
35E
31E
130E
33E
20E
41E
43E
40E
171
172
42E 132B
32B
181
180
131B
183
30B
39B
39B
31B
195
193
190
192
193
194
195
191
20B
69B
43B
40B
41B
69B
44B 260
265
261
262
265
266
270
271
276
275
266
272
282
284
264
283
280
281
283
264
292
30C
274
293
290
291
294
274
293
20C
40C
69C 321
371
370
364
361
369
395
392
394
395
393
390
391
381
380
385
384
383
384
321
327
371
370
373
369
350
351
332
343
342
340-2
341
340-1
334
333
337
332
331
341
340-3
341
340-4
342
343

HAND-HELD DEPILATING DEVICE WITH A PAIN MASKING STIMULATOR

BACKGROUND OF THE INVENTION

1. Field of the Invention

The present invention is directed to a hand-held depilating device for plucking hairs from the skin of a user, and more particularly to such device having a stimulator providing stimuli to the skin for masking the pain of plucking the hairs.

2. Description of the Prior Art

U.S. Pat. No. 5,507,753 discloses a depilating device which comprises a plucking head for plucking the hairs from the skin of a user and a passive roller which is mounted separately from the plucking head to be made in rolling contact with the skin as the plucking head is moved across the skin. The roller acts to smooth or stretch a portion of the skin from which the hairs are plucked by the plucking head to thereby alleviate a pain by an effect of reducing resistance to a force of pulling the hairs. However, even with the stretching by the rolling contact of the roller, there remains a problem that the pain itself may be perceived still significantly by the user. Further, European Patent EP-A-0 493 849 A1 discloses a depilating device with a vibrator which exerts forces of varying intensity on the skin while plucking hairs by pinching them between a pair of rotating rollers. The rollers are held at a fixed position to rotate continuously to be always ready for introducing, pinching, plucking and releasing the hairs. In other words, the rollers or plucking members do not move as a whole relative the skin and therefore do not give a definite depilating cycle consisting of a hair introducing step, a hair pinching step, a hair plucking step, and a hair releasing step. Due to the lack of the depilating cycle, the stimuli cannot be synchronized with the above steps in an attempt to effectively and consistently mask the pain of plucking the hair.

SUMMARY OF THE INVENTION

In order to further alleviate the pain experienced at the time of plucking the hairs, the inventors have studied a mechanism of pain including nerve systems as well as sense receptors in the skin. Through this study, it is found effective to give stimuli to the skin at a suitable timing or timings in order to considerably alleviate the pain caused by plucking the hairs. The present invention is accomplished based upon the above finding and comprises a depilator housing to be grasped by the hand of the user and a plucking head mounted on top of the housing for plucking the hairs from the skin. The plucking head comprising a plurality of pinching elements arranged along a horizontal axis in a closely adjacent relation to form therebetween gaps for entrapping the hairs therein wherein at least one of the adjacent pinching elements is driven to move relative to the other in a direction of successively opening and closing the gaps so as to pinch the hairs between the adjacent pinching elements and release the hairs therefrom. A cycler or turning mechanism is included to cyclically move the plucking head in a direction crossing with the horizontal axis to define, in combination with the movement of closing and opening the gaps, repeated depilating cycles each consisting of introducing the hairs between the adjacent pinching elements, pinching the hairs therebetween, plucking the hairs from the skin, and releasing the hairs from between the pinching elements. Also mounted to the top of the housing adjacent to the plucking head is a simulator which applies stimuli to the skin independently of the plucking head. The present depilating device is improved to include a synchronous mechanism for synchronizing a timing of applying the stimuli with the depilating cycle. Therefore, the stimuli can be made at an optimum timing or timings within the depilating cycle to act on sense receptors other than nociceptors that respond to pain, thereby masking the pain caused by plucking the hairs or received at the nociceptors. That is, the stimuli applied at suitable timing or timings can activate Meissner's corpuscle or Pacinian corpuscle to make indistinct to the pain as demonstrated by a gate-control theory in psychology.

Accordingly, it is a primary object of the present invention to provide a hand-held depilating device which is capable of masking and alleviating the hair plucking pain effectively by suitably synchronizing the timing of applying the stimuli with the depilating cycle.

The stimulator may comprises a vibrator of generating the stimuli of applying vibrations and/or skin stretcher of developing the stimuli of applying a force of stretching the skin. The use of the skin stretcher gives an additional effect of reducing the resistance to the force of pulling the hairs and therefore reducing the pain itself.

In a preferred embodiment, the cycler mechanism is designed to rotate the plucking head about the horizontal axis for achieving the depilating cycle. In association therewith, the synchronous mechanism comprises a cam mounted on the plucking head to be rotatable therewith, and a cam follower which is engageable with the cam and connected to the stimulator for applying the stimuli in synchronous with the rotation of the plucking head . Such simple combination of the cam and cam follower makes it easy to realize the optimum timing or timings of applying the stimuli within the depilating cycle, which is therefore another object of the present invention.

The synchronous mechanism is designed to apply the stimuli to the skin while the plucking head acts to pluck the hairs from the skin. Preferably, the stimuli may be applied at the beginning of plucking the hairs by the plucking head.

In addition, the synchronous mechanism is designed to apply no stimulus to the skin while the plucking head acts to entrap the hairs between the pinching elements. Thus, the hair pinching can be made in such a manner as to keep the skin intact from the stimuli, thereby facilitating to grasp the hair at its root between the pinching elements for successfully plucking the hair in the subsequent step.

Alternately or in combination with applying and not applying stimulus at the above timing, the synchronous mechanism may be further designed to apply the stimuli to the skin while the plucking head acts to introduce the hairs between the pinching elements. Since the stimulus is not preferred to be applied during the hair pinching step in order to grasp the root of the hair, the stimuli applied in the hair introduction step immediately preceding the hair pinching step can remain effective in the subsequent hair plucking step for masking the pain of plucking the hair. In this connection, it is preferred that the synchronous mechanism is designed to apply the stimuli to the skin at the end of the hair introduction step to give the stimuli at a timing closer to the hair plucking step.

In a preferred mode, the simulator is in the form of a movable member having a one pivot end pivotally supported to the top of the housing and having a stimulator element at the other end. The cam follower is formed on the movable member at a middle portion between the pivot end and the opposite end provided with the stimulator element. Thus, the cam follower movement is magnified to produce the sufficient mechanical vibrations of the stimulator element.

The stimulator may comprises more than one stimulator elements acting simultaneously to apply the stimuli to the skin at different portions for masking the hair plucking pain.

In a preferred embodiment, the stimulator in the form of the skin stretcher is pivotally supported at its lower pivot end to the top of the housing and is driven to swing about the pivot end in a direction of moving towards and away from the plucking head. Due to the swinging movement of the skin stretcher, the hair can be prevented from being pulled around the skin stretcher and therefore achieve safe smoothing of the skin for alleviating the pain as well as facilitating the hair plucking. Preferably, a pair of the skin stretcher are disposed on opposite sides of the plucking head and are driven to swing towards and away from each other for further alleviating the pain and facilitating the hair plucking.

The skin stretcher is connected to a drive arm to be driven thereby to swing about the pivot end. The drive arm is pivotally supported at its one arm end to the top of the housing opposite of the plucking head from the skin stretcher so as to pivot about the arm end. The drive arm is connected at an end opposite of the arm end by means of a link to the skin stretcher at a portion offset from the pivot axis so that the pivotal movement of the drive arm causes the skin stretcher to swing about the pivot axis. Thus, the intended swinging movement is given to the skin stretcher by the use of such simple link mechanism.

Further, the skin stretcher is configured to stretch the skin when driven to swing outward in a direction away from the plucking head while the plucking head plucks the hairs from the skin, which is advantageous for further alleviating the pain as well as facilitating the hair plucking.

These and still other objects and advantageous features of the present invention will become more apparent from the following description of the embodiments when taken in conjunction with the attached drawings.

DETAILED DESCRIPTION OF THE EMBODIMENTS

First Embodiment <FIGS. 1 to 13>

Figure 4:
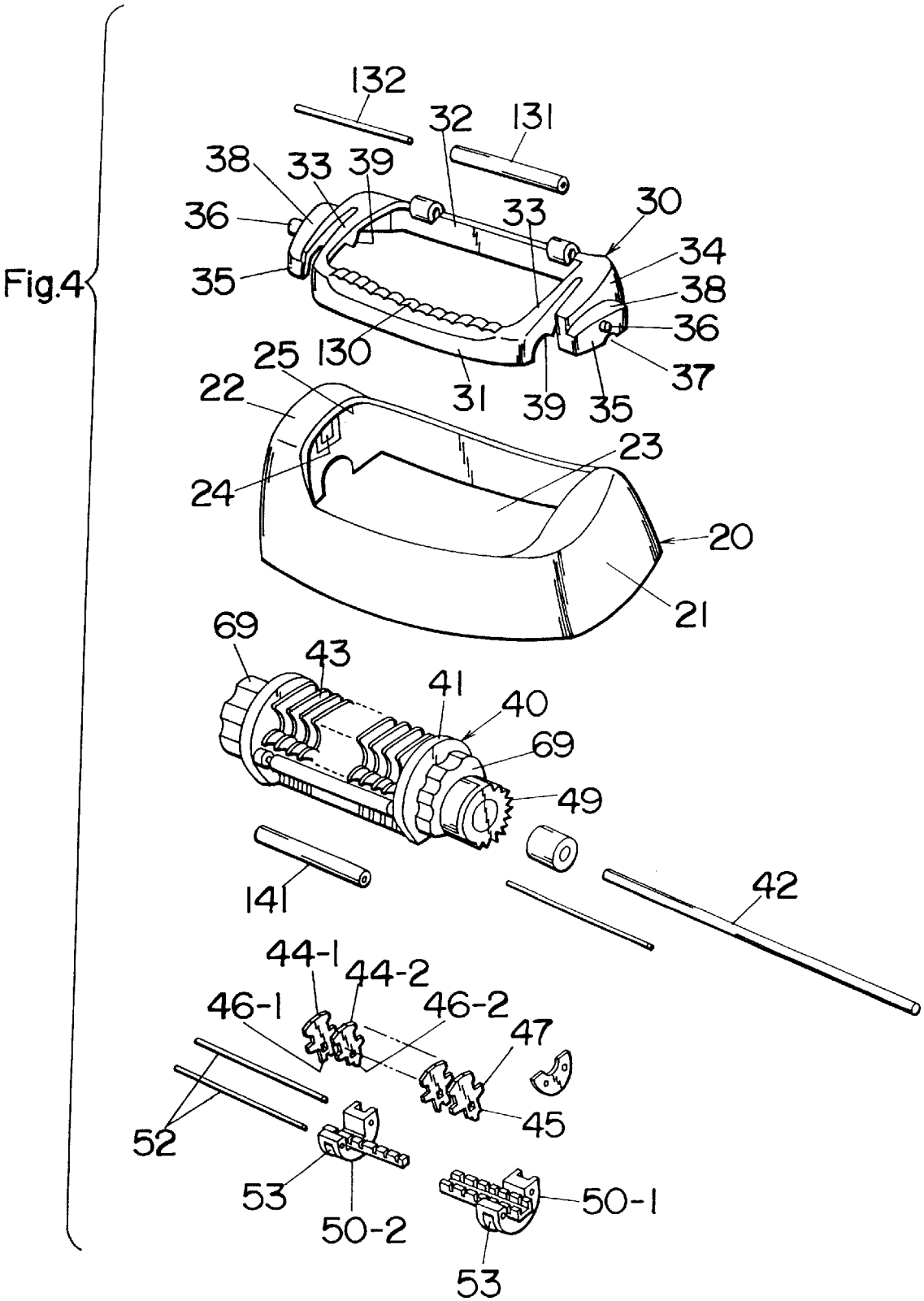
FIG. 4 is an exploded perspective view of the plucking head and an associated skin guide frame with a stimulator.

Referring to FIGS. 1 to 4, there is shown a depilating device in accordance with a first embodiment of the present invention. The device comprises a housing 10 mounting a head frame 20 with a generally rectangular opening and a plucking head 40 disposed within the head frame 20 to be exposed through the opening. The housing 10 incorporates a chassis 60 mounting a motor 70, a positive return cam 80, and a drive mechanism for the plucking head 40. The housing 10 is provided with a power switch 13 for turning on and off the motor 70 and also with a pair of terminal pins 14 for electrical connection to an AC power adapter to energize the motor 70. As best shown in FIG. 4, the head frame 20 is in the form of a top and bottom opened rectangular frame having a pair of end walls 21 between which the plucking head 40 is received. The head frame 20 is detachably mounted on the upper end of the housing 10 by means of a hook 15 and carries a skin guide frame 30 which comes into contact with the skin of the user for guiding the plucking head 40 across the skin.

The plucking head 40 comprises a carrier 41 rotatably supported about a shaft 42 which extends horizontally between the upper ends of the chassis 60 to define a longitudinal axis of the plucking head. The carrier 41 is formed with a series of fixed pinching blades 43 of an arcuate edge configuration arranged along the longitudinal axis. The fixed pinching blades 43 are made of a plastic material having some elasticity and are molded integrally with the carrier 41 to provide a unitary structure. Mounted on the carrier 41 are movable pinching blades 44-1 and 44-2 which are arranged along the axis of the shaft 42 in an alternating relation to the fixed pinching blades 43. The movable pinching blades 44-1 and 44-2 are commonly supported loosely on the shaft 42 to be rotatable thereabout together with the carrier 41 and the fixed pinching blades 43. The movable pinching blades 44-1 and 44-2 are arranged along the axis of the shaft 42 alternately to each other and are secured at their lower ends respectively to first and second sliders 50-1 and 50-2 which are slidably supported by axles 52 held in the lower end of the carrier 41 and which are driven to reciprocate in parallel with the shaft 42 but in the opposite directions to each other, as will be discussed later. The movable pinching blades 44-1 and 44-2 are formed at their ends respectively with a pair of spaced anchor legs 46-1 and a single anchor leg 46-2 which are press-fitted to corresponding notches formed in the sliders 50-1 and 50-2, respectively. Each of the movable pinching blades 44-1 and 44-2 are also formed to have a pair of side tabs 47 on the opposite sides of a hole 45 through which the shaft 42 extends. The side tabs 47 are press fitted to corresponding grooves formed in the carrier 41 so that the movable pinching blades are allowed to swing about the individual connections of the side tabs 47 with the grooves toward and away from the adjacent fixed pinching blades 43 as the anchor legs 46 are caused to move axially by the reciprocation of the sliders 50-1 and 50-2. Thus, the movable pinching blades are driven to swing or to have the upper edges displaced axially toward and away from the adjacent fixed pinching blades 43 so as to repeat clamping the hairs between the movable and fixed pinching blades and releasing the hairs for plucking the hairs in association with an oscillatory movement of the carrier 41 about the shaft 42, the detail of which will be discussed later.

Referring back to FIG. 1, the chassis 60 supports a plurality of gears for establishing a drive connection from the motor 70 to the positive-return cam 80 as well as for oscillating the carrier 41, i.e., the plucking head 40 about the shaft 42. The positive-return cam 80 is provided in the form of a cylinder with a pair of circumferentially extending grooves 81 which are symmetrical to each other such that the horizontal distance between the grooves varies in the circumferential direction. The cam 80 is journaled at its opposed ends by means of bearings 82 in the chassis 60 to be rotatable about a horizontal axis and is operatively connected to the sliders 50-1 and 50-2 by means of cam cylinders 90. The cam cylinder 90 comprises a barrel 91 supported to the chassis 60 by means of a vertical pin (not shown) to be rotatably about a vertical axis. Projecting upwardly from the barrel 91 is a pin 95 which is slidably received in an arcuate furrow 53 formed in the bottom of each of the sliders 50-1 and 50-2. The barrel 91 is also provided on its lower end with a cam follower 97 for slidable engagement into each one of grooves 81 of the cam 80 such that the rotation of the cam 80 is translated into reciprocating movement of the sliders 50-1 and 50-2 along the shaft 42 through a swinging movement of the cam cylinders 90, thereby displacing the movable pinching blades 44-1 and 44-2 in the axial direction to move their upper edge into abutment and away from the associated fixed pinching blades 43.

Thus, the rotation of the cam 80 causes the sliders 50-1 and 50-2 to reciprocate along the axis of the shaft 42 in opposite directions, thereby displacing a set of alternate movable pinching blades 44-1 in the same direction and at the same time displacing the other alternate set of the movable pinching blades 44-2 in the opposite direction. In this manner, every set of two adjacent movable pinching blades 44-1 and 44-2 are caused to swing in the opposing directions to have their upper edges abutted against on both sides of the common fixed pinching blade 43 located between the two adjacent movable pinching blades 44-1 and 44-2 in order to clamp the hairs therebetween.

Figure 1:
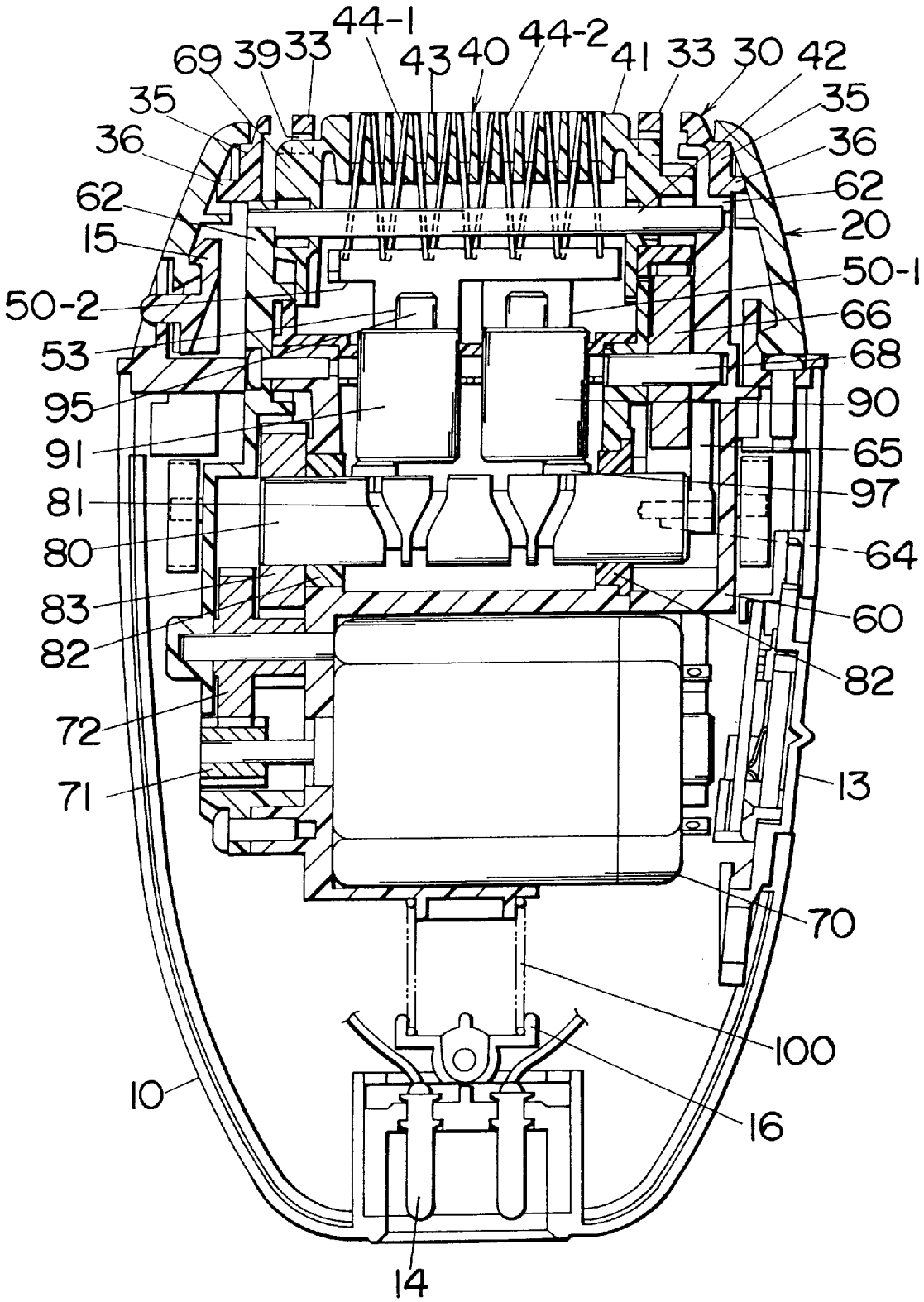
FIG. 1 is a front vertical section of a depilating device in accordance with a first embodiment of the present invention.
Figure 2:
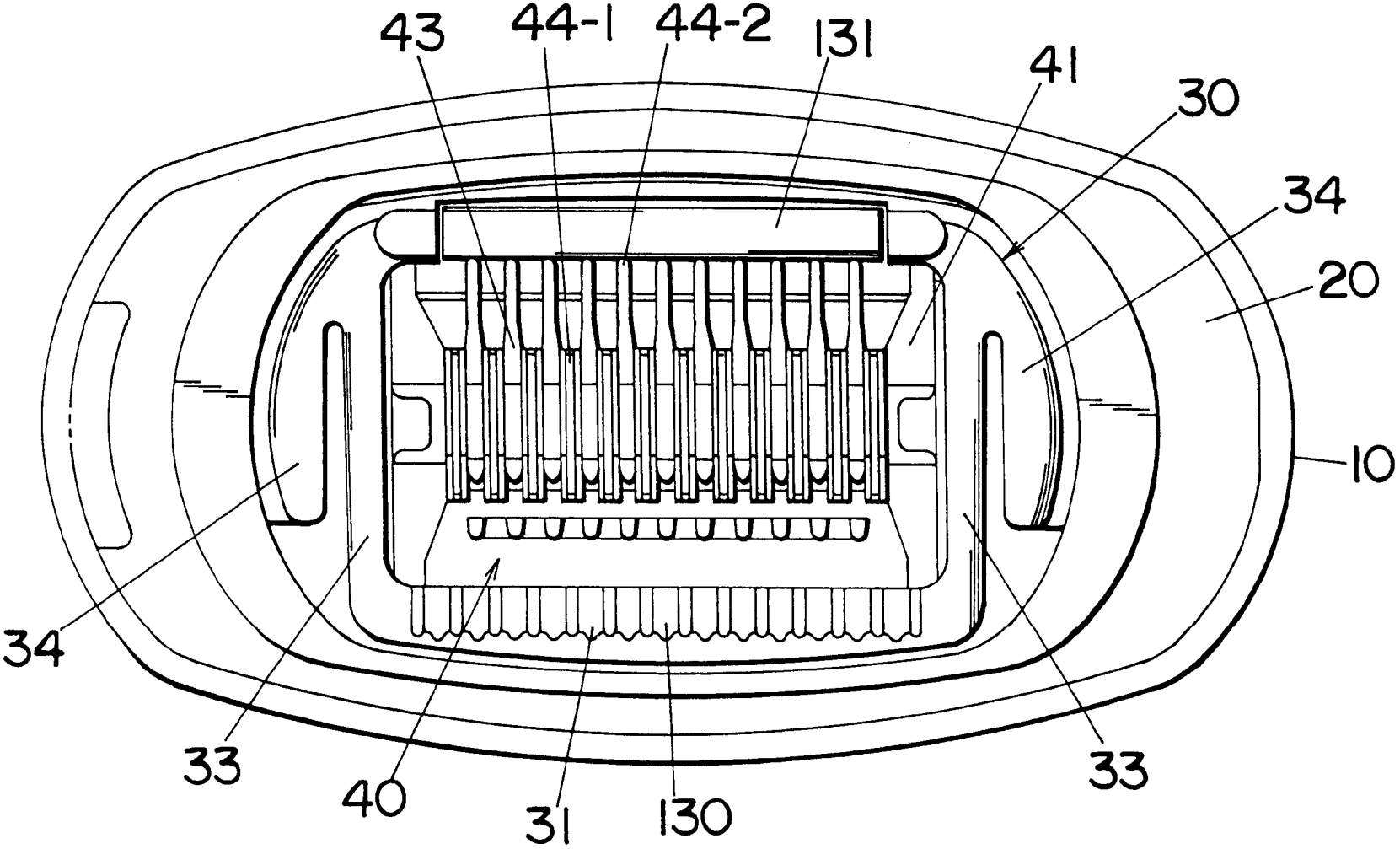
FIG. 2 is a top view of the depilating device.
Figure 3:
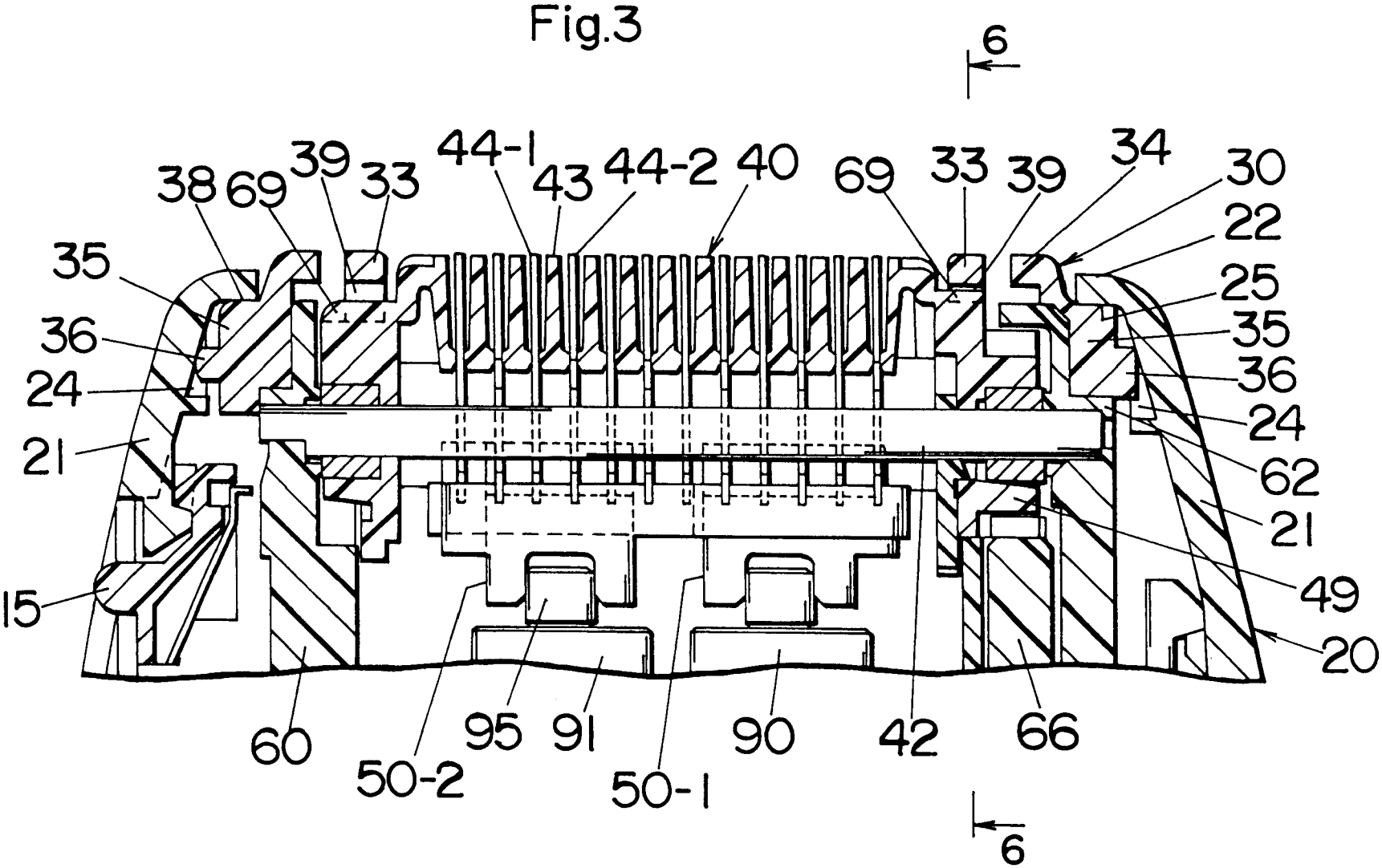
FIG. 3 is front vertical section of a plucking head of the device.

As shown in FIG. 1, the motor 70 is operatively connected to the cam 80 through a reduction gear train of a pinion 71 of the motor 70, a first gear 72 and a second gear 83 fixed on one end of the cam 80. The cam 80 is linked to one end of a crank lever 65 by means of an eccentric pin 64 which is eccentric to the horizontal axis of the cam 80. The other end of the crank lever 65 is coupled to a partially toothed rack wheel 66 by means of a pivot pin (not shown) which is eccentric to a shaft 68 carrying the rack wheel 66. The rack wheel 66 is in meshing engagement with a gear 49 on one axial end of the carrier 41 so that the rotation of the eccentric pin 64 about the axis of the cam 80 is translated into an oscillating rotary movement of the rack wheel 66 about the shaft 68 and therefore the corresponding movement of the gear 49 or the plucking head 40 about the shaft 42. That is, the plucking head 40 is caused to oscillate about the shaft 42 in synchronism with the plucking movement of displacing the movable pinching blades in the axial direction of the shaft 42, and is so arranged as to complete one oscillation cycle while the cam 80 rotates one rotation about its horizontal axis such that the movable pinching blade is caused to move toward and away from one of the two adjacent fixed pinching blades during one oscillation cycle of the plucking head 40 about the shaft 42 and to move toward and away from the other fixed pinching blade during subsequent oscillation cycle of the plucking head 40. More detailed operation of the plucking head 40 is explained in the European Patent Application No. 92102760.3 and therefore is omitted herein. However, it is noted here that the plucking head 40 is driven to oscillate about its longitudinal axis between a limited angular range such that the clamping edges of the pinching blades are caused to advance into the opening of the head frame 20 and retard inwardly into the head frame 20, during which swinging movement the hairs are plucked as being clamped between the adjacent pinching blades. That is, the one oscillation cycle of the plucking head 40 is associated with a depilating cycle of the pinching blades consisting of a hair introduction step of introducing the hair between the movable and fixed pinching blades, a hair pinching step of pinching the hairs between the blades, a hair pluck step of plucking the hair from the skin, and a hair release step of releasing thus plucked hair from between the blades.

The plucking head 40 is disposed at the upper end of the head frame 20 together with the skin guide frame 30 so as to define an advancing direction along which the guide frame 30 is moved by the user in contact with the skin for successively plucking the hairs over a wide area of the skin. The advancing direction is defined to be perpendicular to the longitudinal axis of the plucking head 40 and correspond to a forward angular movement of the plucking head 40 about its longitudinal axis in which the clamping edges of the pinching blades swings about the longitudinal axis outwardly for entrapping the hairs between the movable and fixed pinching blades. That is, when moving the skin guide frame 30 in contact with the skin in the advancing direction, the plucking head 40 will follow that direction as moving forward from the behind in circumferential direction about the longitudinal axis of the plucking head 40. The plucking head 40 is additionally provided with a smooth roller 141 which extends in parallel with the longitudinal axis of the plucking head and is located forwardly of the pinching blades with respect to a direction of moving the pinching blades into contact with the skin from the inwardly retracted position, such that the roller 141 comes into contact with the skin for smoothing the skin prior to plucking the hairs therefrom.

The plucking head 40 is mounted on the chassis 60 together with the motor 70 as well as the other components establishing the driving connection therebetween so that almost all of the components are integrated into a single unit. The chassis 60 is floatingly supported within the housing 10 by means of a coil spring 100 so that the plucking head 40 can be depressed inwardly into the housing 10 to a limited extent and therefore can readily follow the contour of the skin without accompanying an excessive counter-force to the plucking head 40 when pressing the head 40 to the skin. As seen in FIG. 1, the coil spring 100 is interposed between the lower end of the chassis 60 and a stand 16 on the interior of the housing 10. The upward displacement of the chassis 60 is limited by engagement of a stopper on the chassis 60 with a corresponding part of the housing 10.

The skin guide frame 30 is disposed around the plucking head 40 for contact with the skin in order to smoothly guide the plucking head when moving the plucking head in the advancing direction. As shown in FIG. 4, the skin guide frame 30 is made of a plastic material into a unitary structure of a generally rectangular configuration having a pair of front and rear bars 31 and 32 integrally connected by opposite end bars 33. Each of the opposite end bars 33 is connected at its rear end integrally with a rigid end support 34. The end bar 33 is made thin to give a sufficient resiliency by which the front bar 31 is allowed to move substantially vertically relative to the end supports 34 with attendant resilient deformation of the end bars 33. The guide frame 30 is fitted within the head frame 20 by loose engagement of pins 36 on the end supports 34 into corresponding vertical grooves 24 in the inner surface of the end walls 21 of the head frame 20 in such a manner that the guide frame 30 is vertically movable relative to the head frame 20. The end support 34 is formed integrally with bearing projection 35 from which the pin 36 projects. The bearing projection 35 has in its lower end with a recess 37 into which a shoulder 62 at the upper end of the chassis 60 engages, as shown in FIGS. I and 5, such that the guide frame 30 can be depressed together with the chassis 60, or the plucking head 40. In other words, the guide frame 30 is floatingly supported together with the plucking head 40 by the coil spring 100, so that the guide frame 30 and the plucking head 40 can be depressed together relative to the housing 10.

Figure 5:
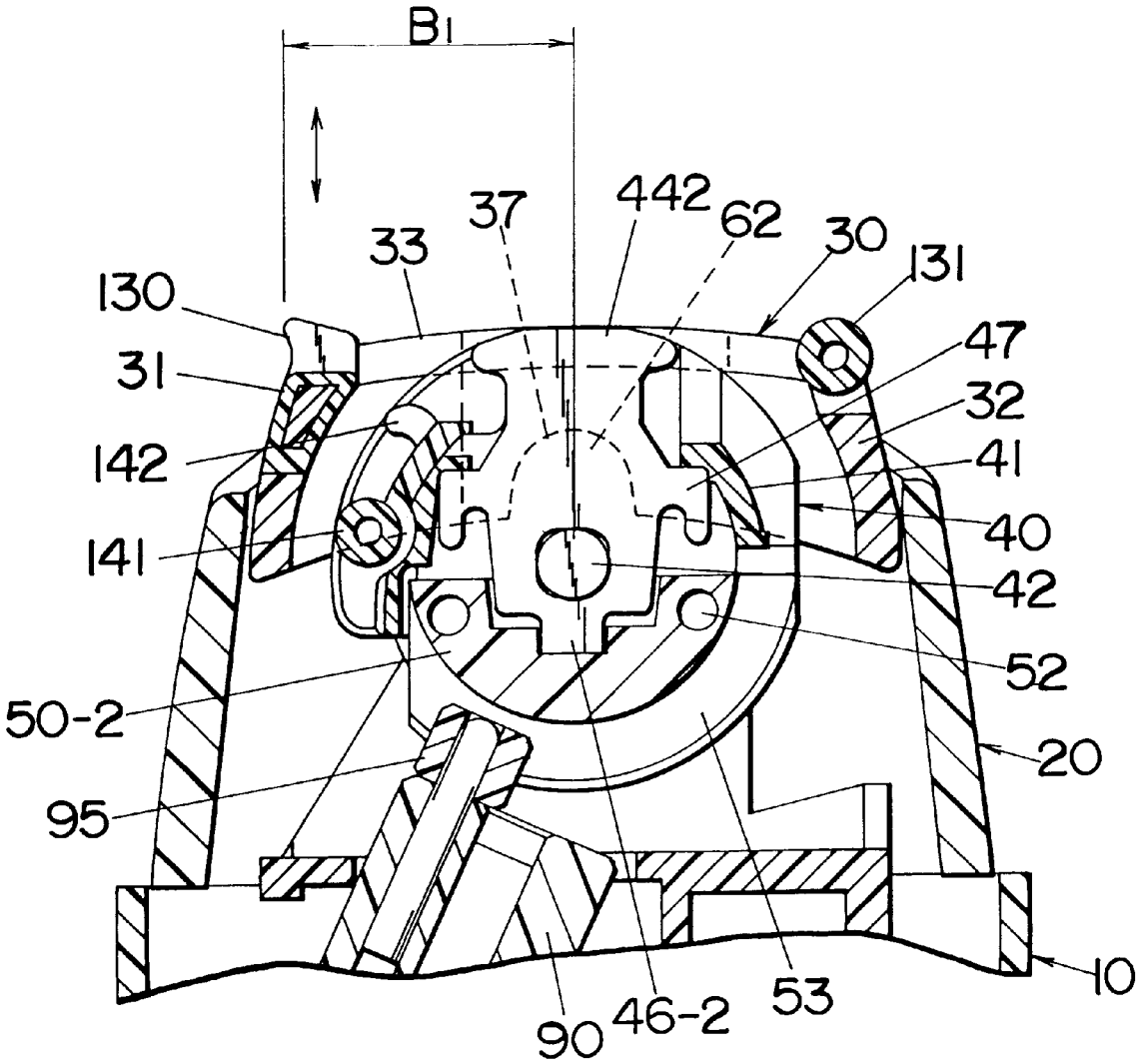
FIG. 5 is a side section of the plucking head and the skin guide frame.
Figure 6A:
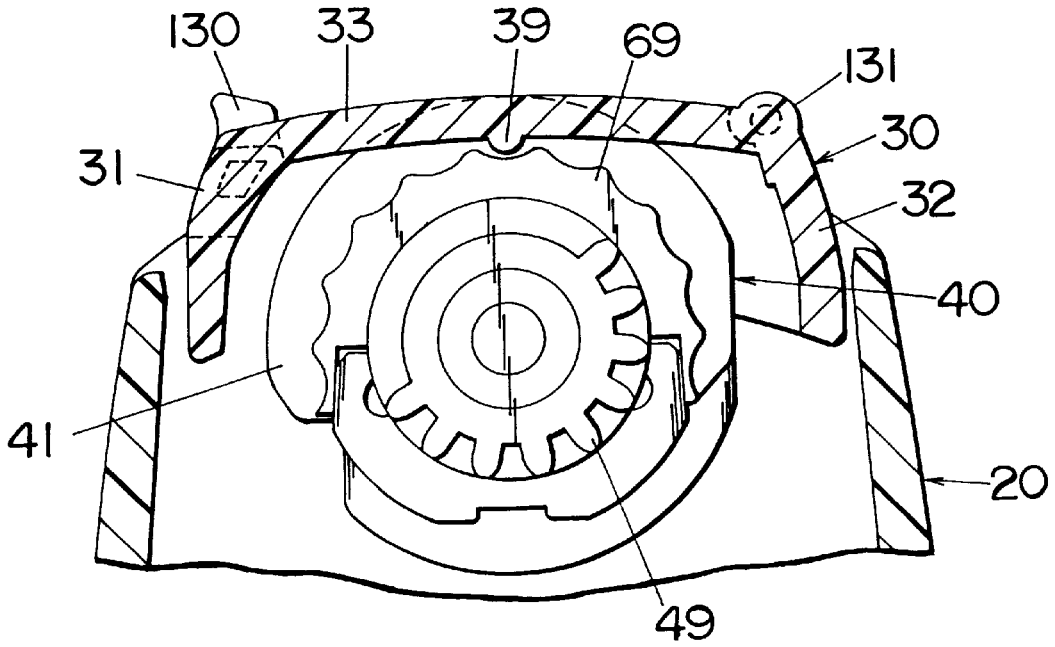
FIGS. 6A and 6B show a mechanism of driving the stimulator of the skin guide frame as viewed in a section taken along a line 6—6 of FIG. 3.
Figure 6B:
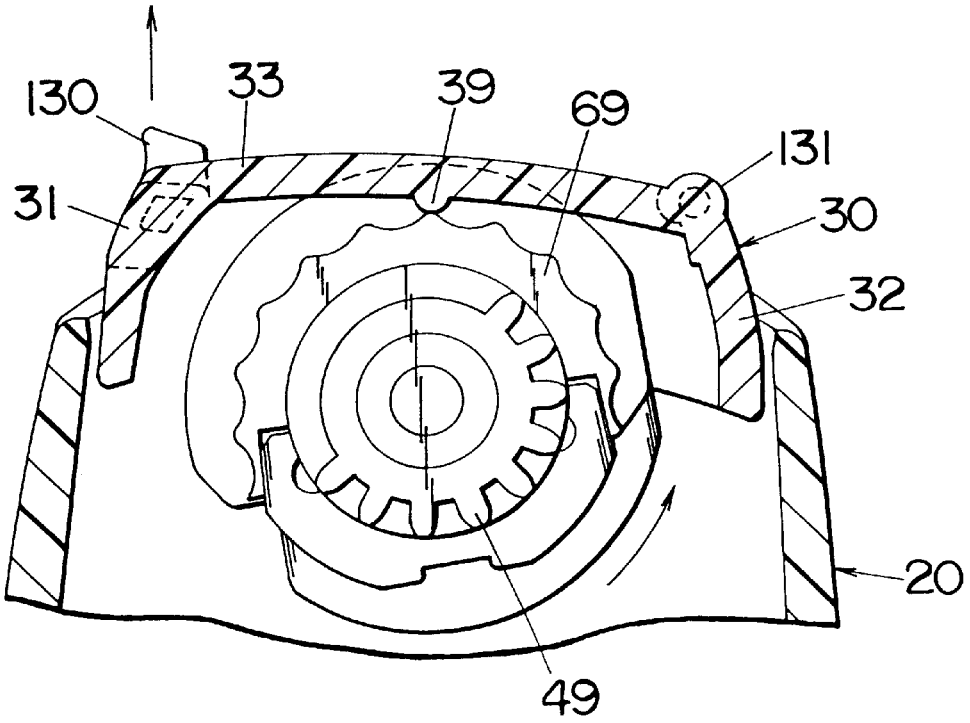
Figure 7A:
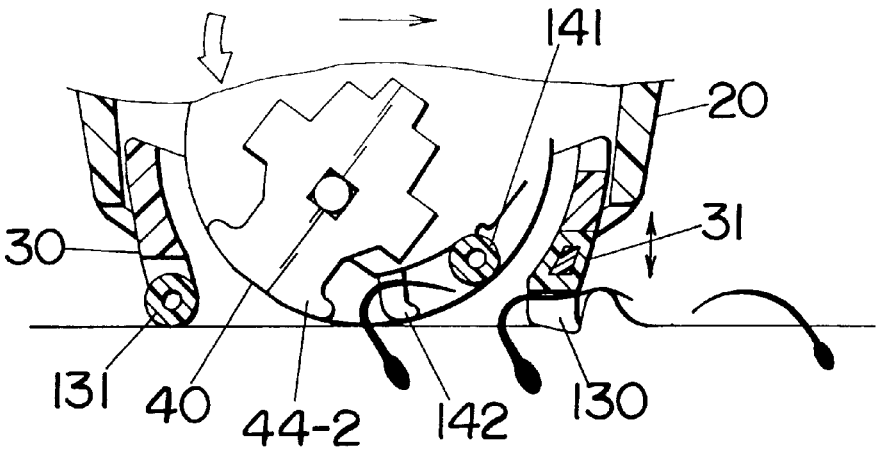
FIGS. 7A, 7B, and 7C show a hair plucking operation with the aid of the stimulator.
Figure 7B:
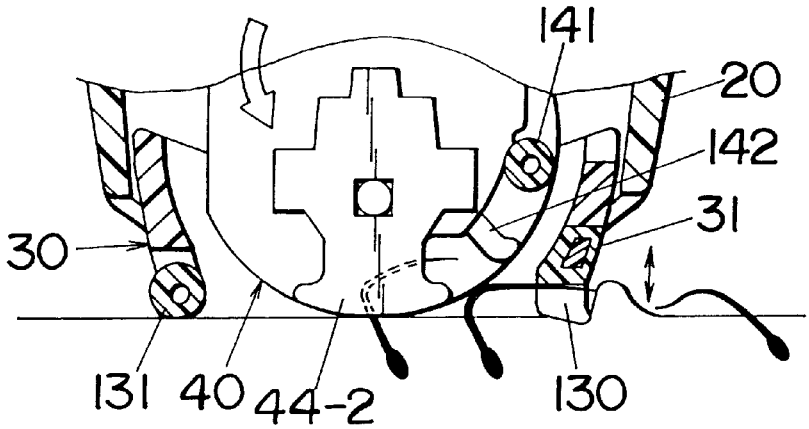
Figure 7C:
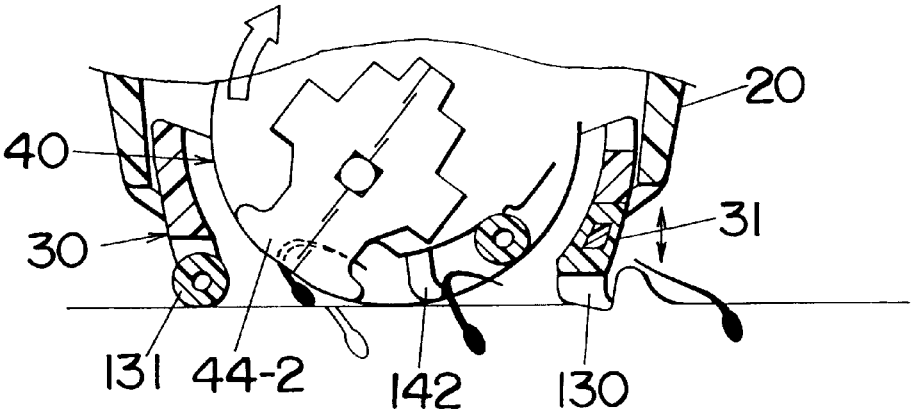

The front bar 31 of the skin guide frame 30 is formed with a series of comb projections 130 which come into contact with the skin for lifting and smoothing the hairs prior to plucking the hairs. The rear bar 32 is provided with a smooth roller 131 for facilitating the skin guide frame to move across the skin. The roller 131 is rotatably supported about a shaft 132 fixed to the rear bar 32. Each of the end bars 33 is provided intermediate its length with a cam follower projection 39 which is engageable with each of cam wheel 69 formed on opposite axial ends of the carrier 41. As the plucking head 40 oscillates or swings about the shaft 42, the cam projection 39 rides up and down the teeth of the cam wheel 69, as shown in FIGS. 6A and 6B, so that the end bar 33 acts as a pawl to thereby vibrate the front bar 31 in a direction, as indicated by an arrow in FIG. 5, i.e., in the direction generally perpendicular to the surface of the skin. The resulting vibrations are applied as mechanical stimuli to the skin from which the hair are being plucked, thereby masking the pain of plucking the hair to alleviate the pain. Thus, the front bar 31 is defined as a stimulator or stimulation applicator which provides the mechanical stimuli of vibrations through the comb projections 130 to the skin as the plucking head 40 is advanced across the skin with the front bar 31 located forwardly of the plucking head 40, as shown in FIGS. 7A to 7C. Thus, the stimulator i.e., the front bar 31 provides the stimuli to the skin during or just before plucking the hair to stimulate Meissner's corpuscle or Pacinian corpuscle to activate the gate control path for alleviating the pain. The vibration is set to have an optimum amplitude and frequency which are determined respectively by the engaging amount of the cam follower projection 39 and the toothed cam wheel 69 and by the tooth pitch of the cam wheel 69. Since the plucking head 40 operates to perform the depilating cycle of introducing, pinching, plucking, and releasing the hair, it is made here to apply the stimuli effectively at an optimum timing or timings in synchronism with the cycle, i.e., to produce the stimuli at the hair plucking step and additionally at the hair introducing step. As shown in FIGS. 7A to 7C, comb fins 142 are formed on the carrier 41 between the guide roller 141 and the pinching blades 44-1 and 44-2 along the circumference of the plucking head 40 so as to guide the hairs smoothly in between the blades.

Figure 8:
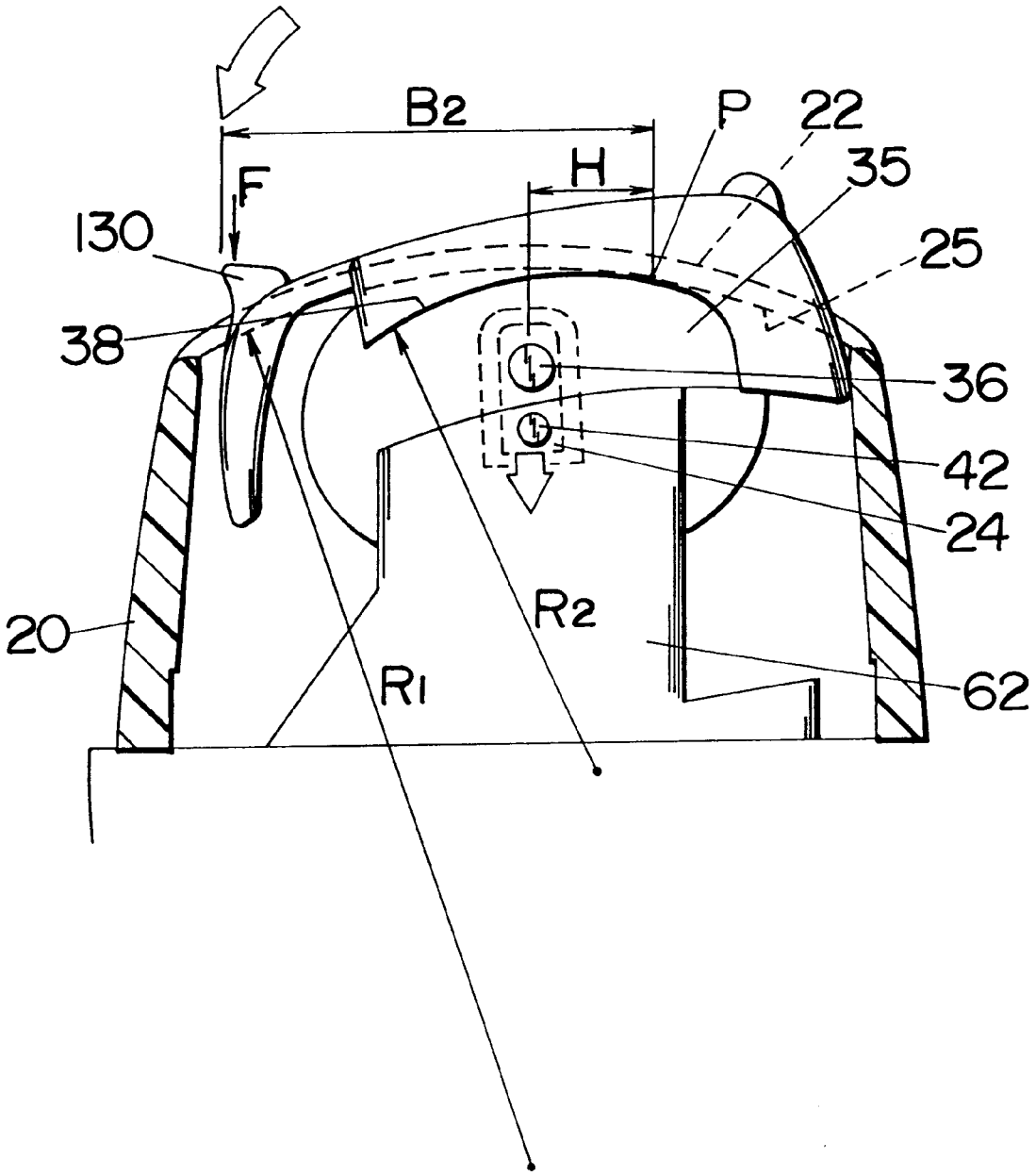
FIG. 8 is a side section showing a combination swing and depression movement of the skin guide frame.

It should be noted here that each of the bearing projection 35 on opposite end of the skin guide frame 30 is shaped to have a curved upper surface 38 which is urged against an inner curved surface 25 of an end flange 22 of the head frame 20, as best shown in FIG. 8, by the action of the coil spring 100. The curved upper surface 38 of the bearing projection 35 has a radius of curvature R2 which is less than a radius of curvature R1 of the inner curved surface 25 of the head frame 20 so that the bearing projection 35 is engaged with the inner curved surface 25 of the head frame only at a point of contact P which moves along the inner curved surface 25 as the front bar 31 is depressed. That is, when no depression force acts on the front bar 31, as shown in FIG. 5, the guide frame 30 is kept in a neutral position as being urged upwardly together with the plucking head 40 by the coil spring 100 where the point of contact P lies on a vertical plane passing through the axis of the pins 36 as well as the shaft 42 and through a portion at which the guide frame 30 receives the upward bias through the plucking head 40, leaving a distance B1 between the front bar 31 and the point of contact P (although not seen in FIG. 5). As a depression force F is applied to the front bar 31 as a result of the that front bar 31 is pressed against the skin, as shown in FIG. 8, the point of contact P moves away by a distance of H from the vertical plane. Consequently, the guide frame 30 is allowed to swing about thus moved point of contact P relative to the head frame 20 with increased distance B2 between the front bar 31 and the point of contact P, which accompanies a corresponding depressive movement of the plucking head 40. That is, as the front bar 31 is depressed, it swings about the moving point of contact P defining a swing axis parallel to the shaft 42 of the plucking head 40 with attendant depressive movement of the plucking head 40. With such combination of the swinging and depression movements, the front bar, i.e., vibrator 31 can be kept in an optimum contact with the skin for alleviation of the pain. It is noted in this connection that the pins 36 on the opposite ends of the guide frame 30 are loosely and slidably engaged with the grooves 24 in the head frame 20 to allow the above combination movement of the guide frame 30.

Figure 9:
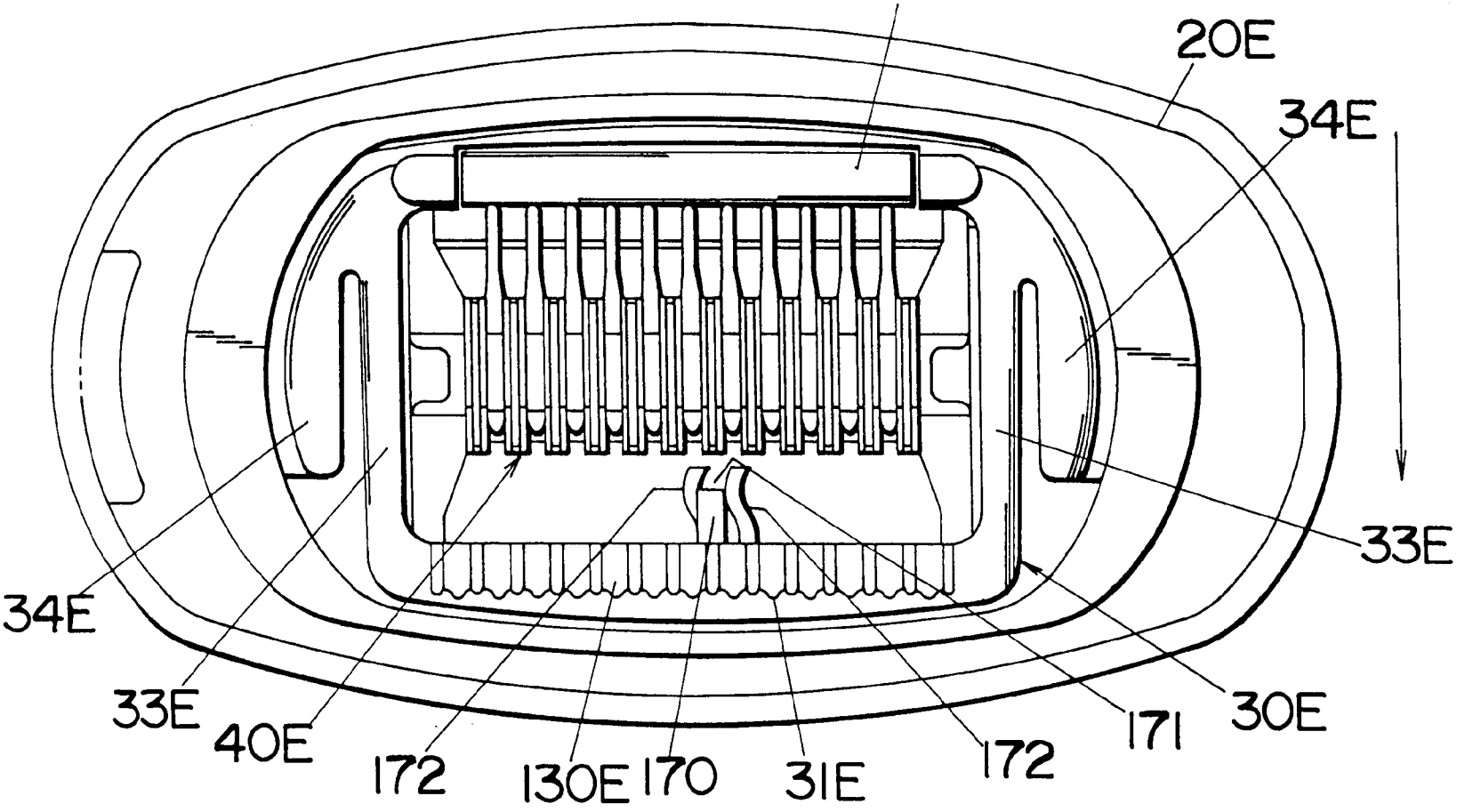
FIG. 9 is a top view of a depilating device in accordance with a second embodiment of the present invention.
Figure 10:
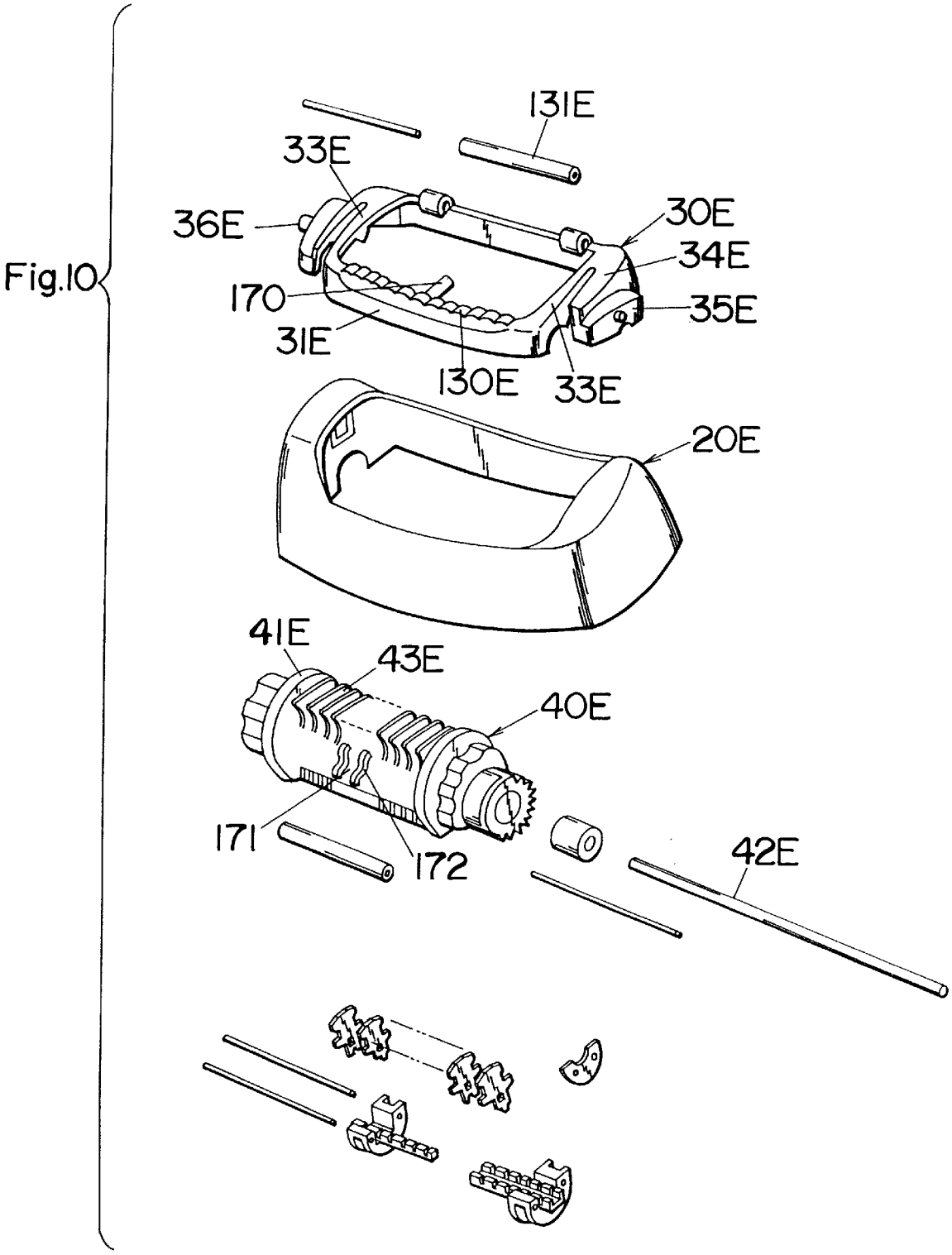
FIG. 10 is an exploded perspective view of the device of FIG. 9.
Figure 11:
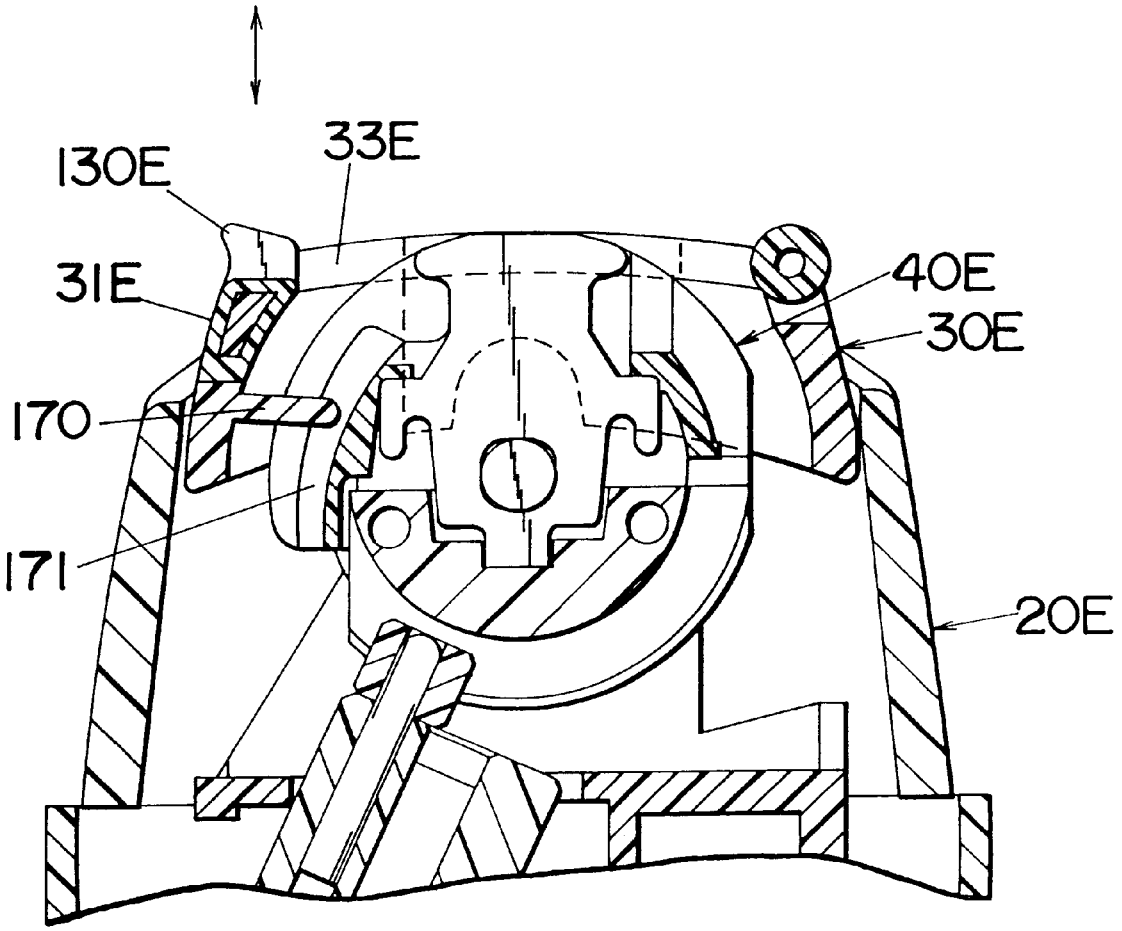
FIG. 11 is a side section of the above device.

Second Embodiment <FIGS. 9 to 11>

Referring to FIGS. 9 to 1, there is shown a second embodiment of the present invention which is identical to the first embodiment except that skin guide frame 30E includes a vibrator 31E which gives lateral vibrations in addition to the above vibrations acting in a direction generally perpendicular to the skin surface. Like parts are designated by like numerals with a suffix letter of "E". The opposite end bars 33E of the guide frame 30E which are connected only at their rear ends to the end support 34E permit the front bar or vibrator 31E move horizontally in the lengthwise direction of the front bar 31E in addition to the vertical direction. Projecting inwardly from the center of the front bar 31E is a follower pin 170 which is engaged into a spiral track 171 defined between a pair of guide rails 172 formed on the carrier 41E at a portion circumferentially spaced from the fixed pinching blades 43E. As the carrier 41E or the plucking head 40E swings about the axis of the shaft 42E, the follower pin 170 is guided along the spiral track 171 to vibrate the front bar 31E also in the lengthwise direction thereof, thereby applying the lateral vibrations to the skin simultaneously with the afore-mentioned vibrations for further enhancing the effect of applying the mechanical stimuli to the skin. It is noted in this respect that the lateral vibration thus given is selected to have a small vibration amplitude which do not bring about any unpleasant skin rubbing.

Figure 12:
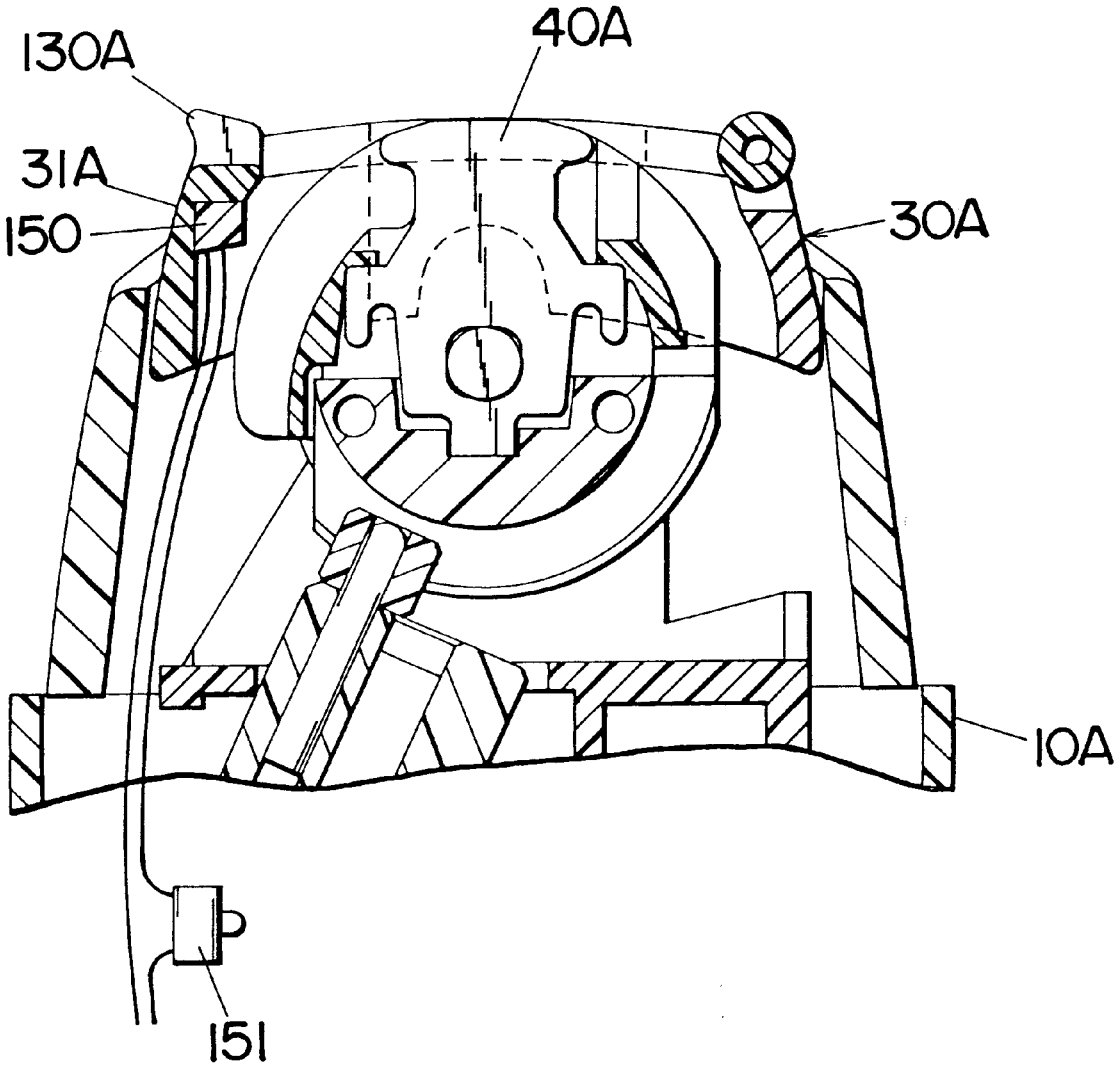
FIG. 12 is a side section of a device in accordance with a modification of the second embodiment.
Figure 13:
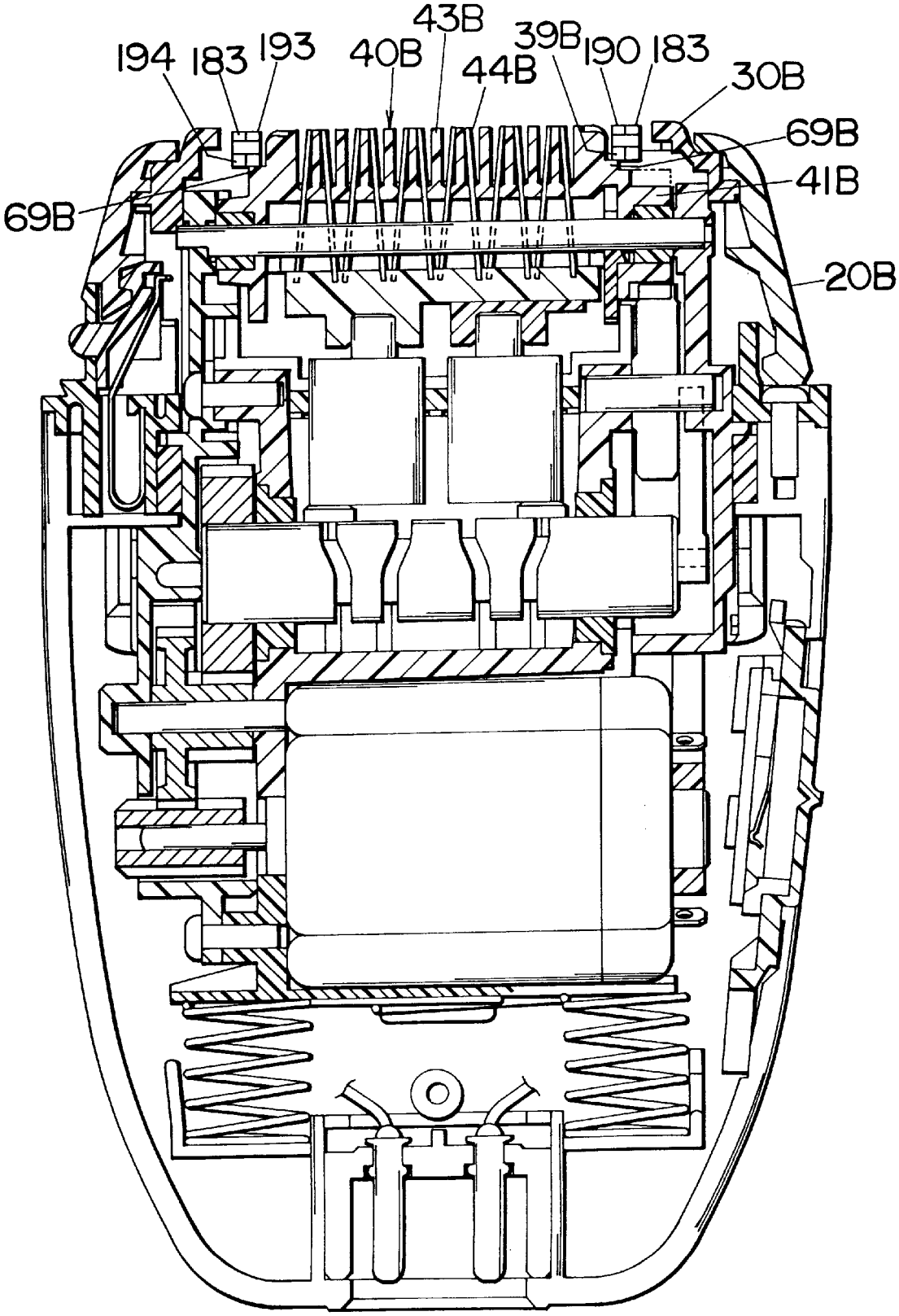
FIG. 13 is a front vertical section of a depilating device in accordance with a third embodiment of the present invention.
Figure 14:
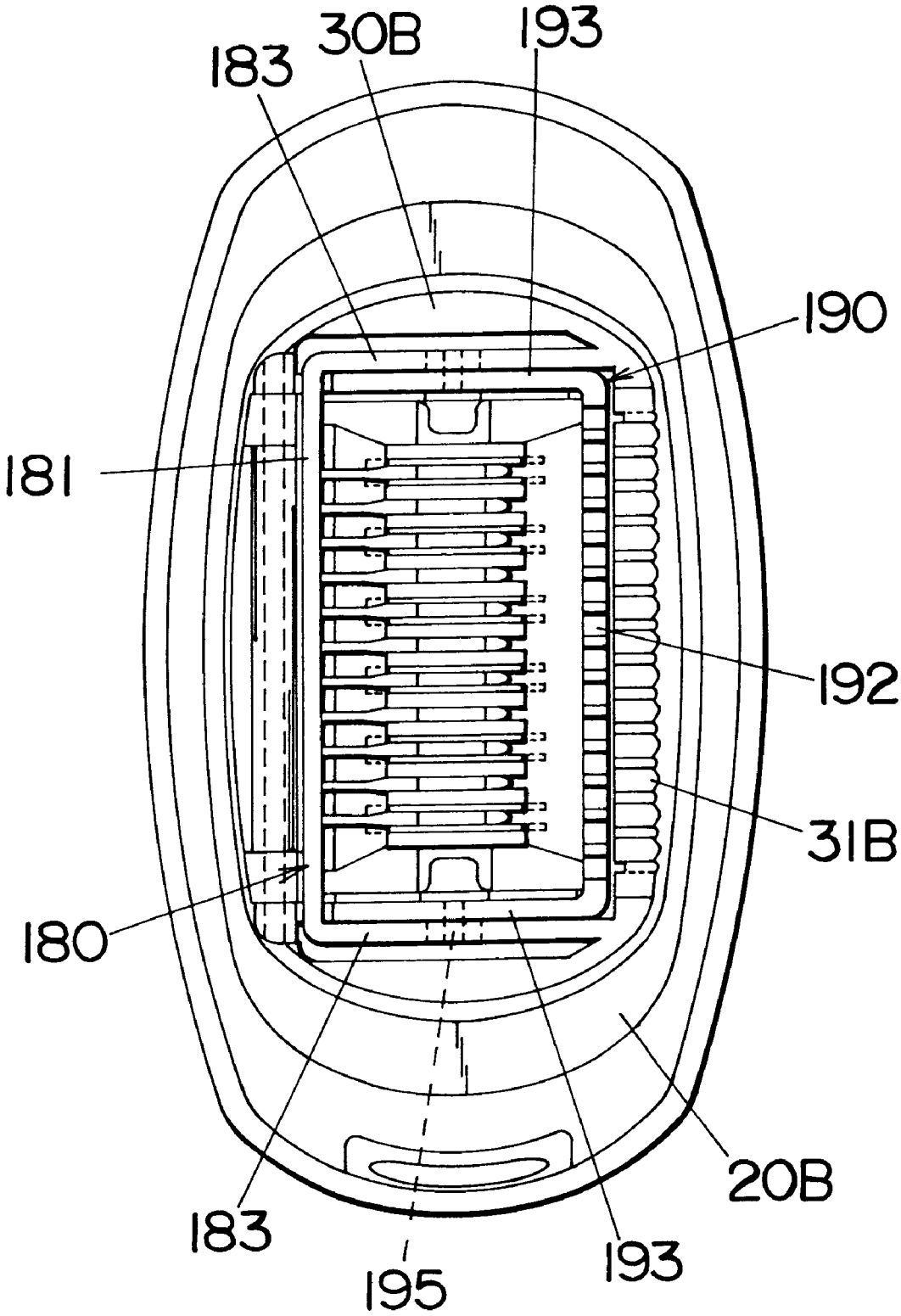
FIG. 14 is a top view of the above device.
Figure 15:
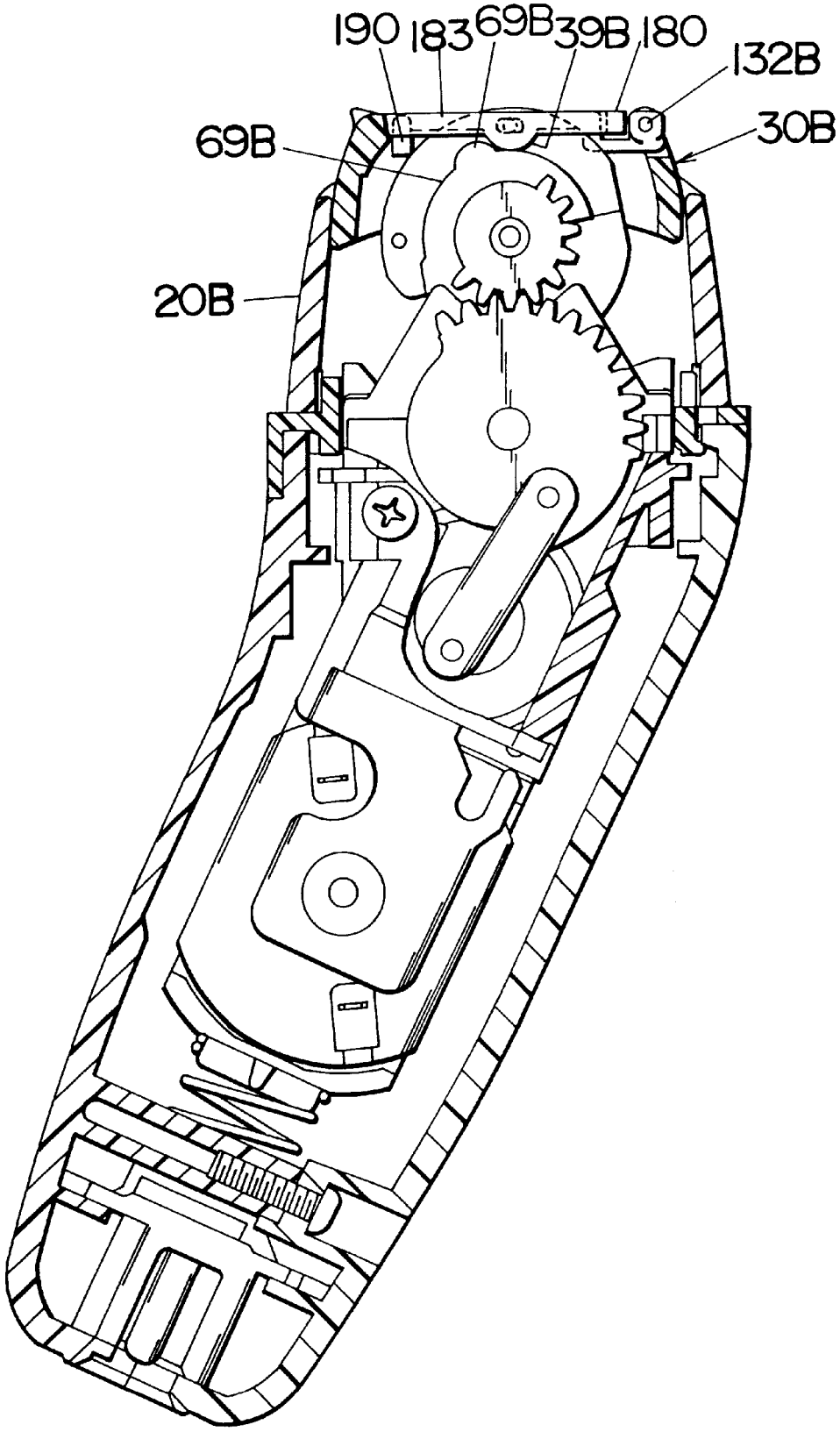
FIG. 15 is a side section of the above device for illustration of a drive mechanism of swinging a stimulator on top of the device.

FIG. 12 shows a modified device in which a like stimulator 31A with comb projections 130A is provided as a front bar of a like skin guide frame 30A and is driven to vibrate vertically by an active element 150 such as a solenoid or piezoelectric element attached to the lower end of the stimulator 31A. The timing of applying the effective stimuli is chosen by a controller 151 provided in the housing 10A. The other structures and functions are identical to the previous embodiments except that no mechanically driving connection is made between the stimulator to the plucking head 40A.

Third Embodiment <FIGS. 13 to 23>

Figure 16:
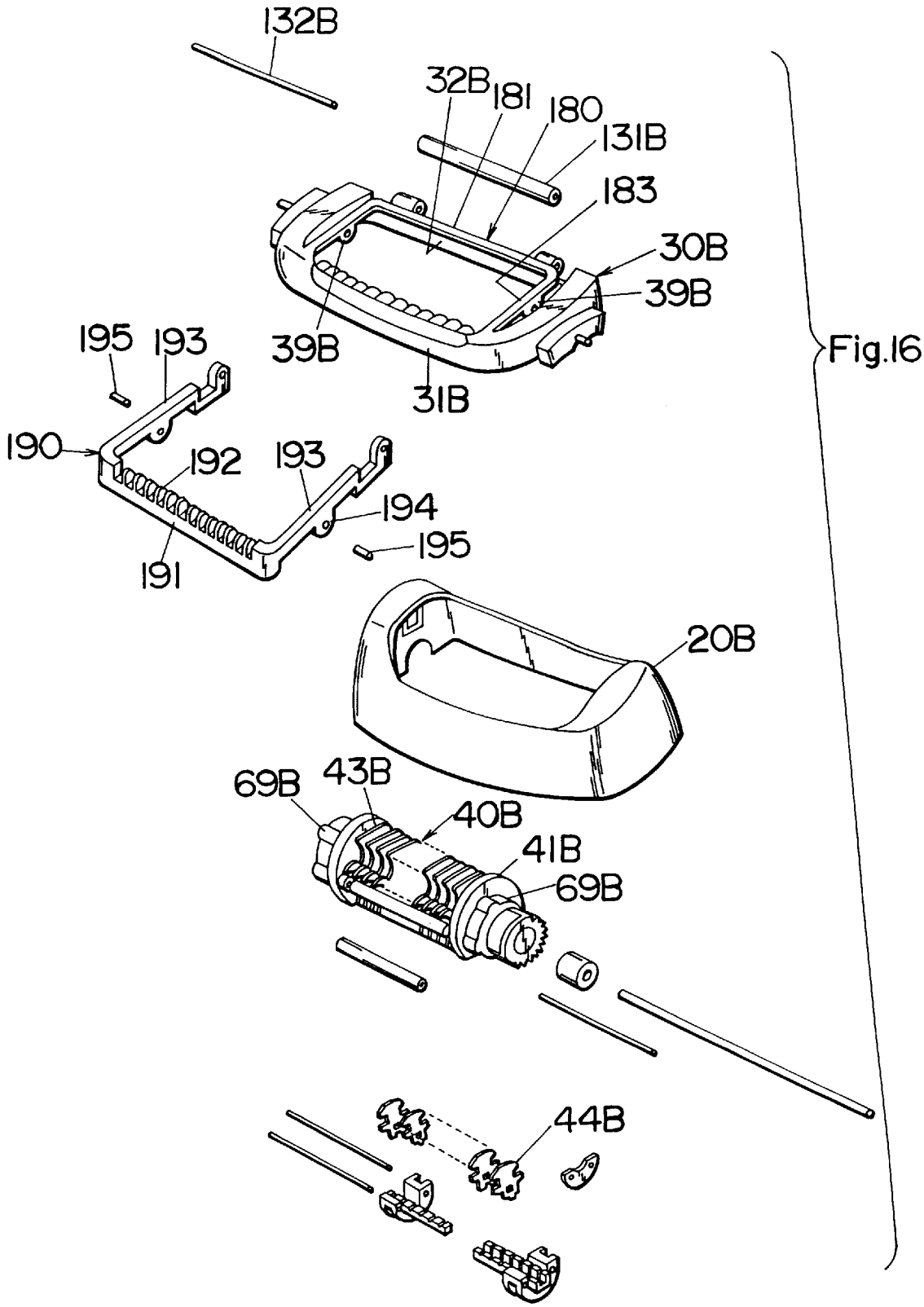
FIG. 16 is an exploded perspective view of the plucking head and an associated skin guide frame with a stimulator.

A depilating device in accordance with a third embodiment is identical in structure and operation to the first embodiment except that a like skin guide frame 30B includes a pair of first and second stimulators 180 and 190. Like parts are designated by like numerals with a suffix letter of "B". As best shown in FIG. 16, the first stimulator 180 comprises a rear member 181 and a pair of resilient end bars 183 extending from the opposite ends of the rear member 181 to merge integrally into a rigid front bar 31B. Thus, the rear member 181 is allowed to move up and down by the use of resiliency of the end bars 183 relative to the front bar 31B, in much the same way as the front bar 31 of the skin guide frame 30 in the first embodiment does in relation to the rear bar 32. The end bars 183 are formed respectively with cam follower projections 39B at the middle of the length thereof for engagement with corresponding cam wheels 69B on opposite ends of a like carrier 41B of a plucking head 40B. Therefore, the rear member 181, which may be termed as a first stimulating element of the first stimulator 180, is caused to apply the stimuli to the skin in synchronism with the depilating cycle of the plucking head 40B.

The second stimulator 190 comprises a front member 191 with a series of comb projections 192 and a pair of parallel arms 193 extending from the opposite ends of the front member 191. The rear ends of the arms 193 is pivotally connected to the rear bar 32B of the guide frame 30B by means of a pin 132B so that the front member 191, which may be termed as a second stimulating element, can move up and down by the associated pivotal movement of the arms around an axis of the pin 132B. The pin 132B also serves to carry a freely rotating roller 131B disposed immediately behind the first stimulating element 181. The opposite arms 193 are formed respectively with cam follower projections 194 which are linked by pins 195 to the cam follower projections 39B of the first stimulator 180 and engageable together with the cam wheels 69B of the plucking head 40B. Thus, the second stimulator element, i.e., the comb projections 192 are caused to apply the stimuli in synchronism with the depilating cycle of the plucking head 40B. The pitch of teeth on the can wheel 69B is selected to give the stimuli at suitable timings in the depilating cycle as discussed hereinafter. The skin guide frame 30B carrying the first and second stimulators 180 and 190 is disposed in the top opening of a like head frame 20B in a like fashion as in the first embodiment.

Figure 17A:
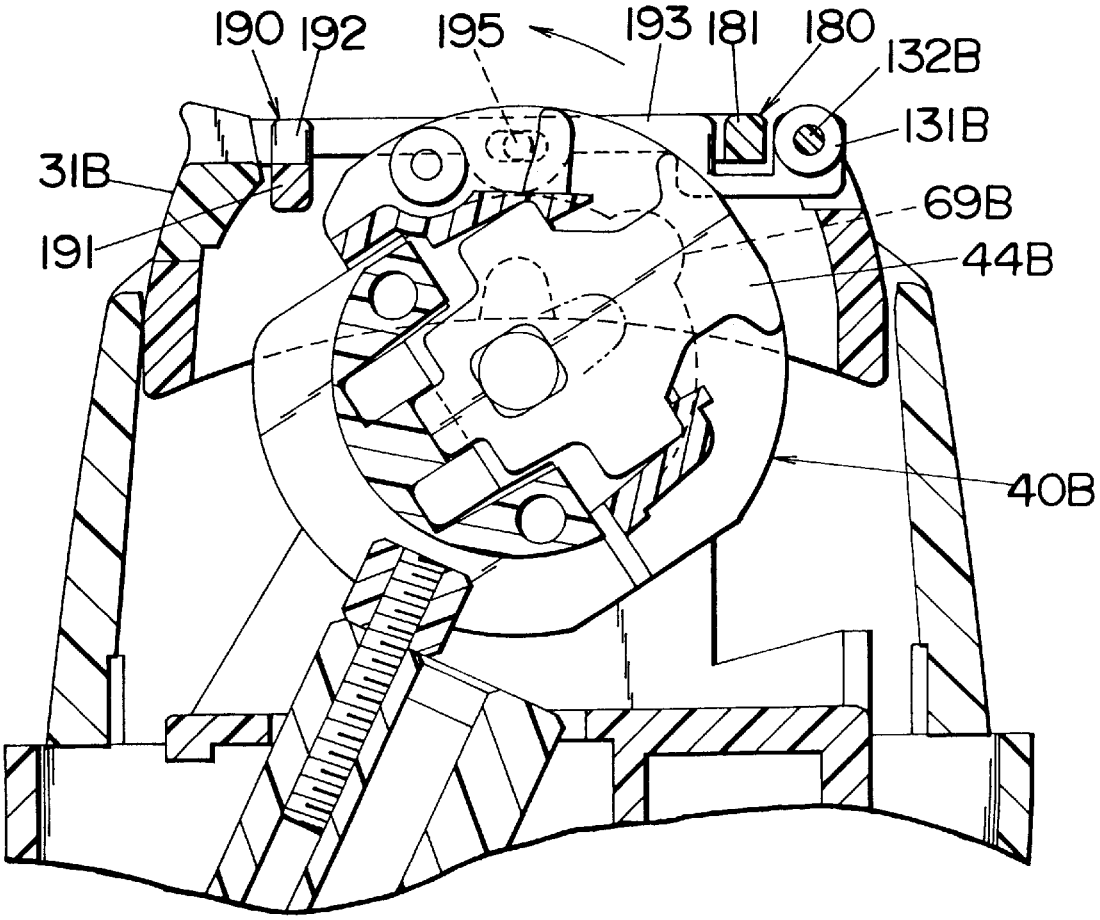
FIGS. 17A, 18A, 19A, 20A, 21A, and 22A are sectional views illustrating in sequence operations of the plucking head and the stimulator.
Figure 17B:
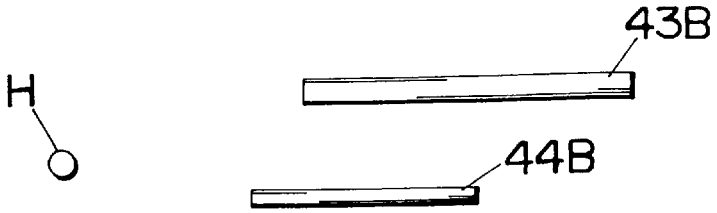
FIGS. 17B, 18B, 19B, 20B, 21B, and 22B correspond respectively to FIGS. 17A, 18A, 19A, 20A, 21A, and 22A and illustrate the relation between two adjacent pinching blades and a hair to be introduced and plucked thereby.
Figure 18A:
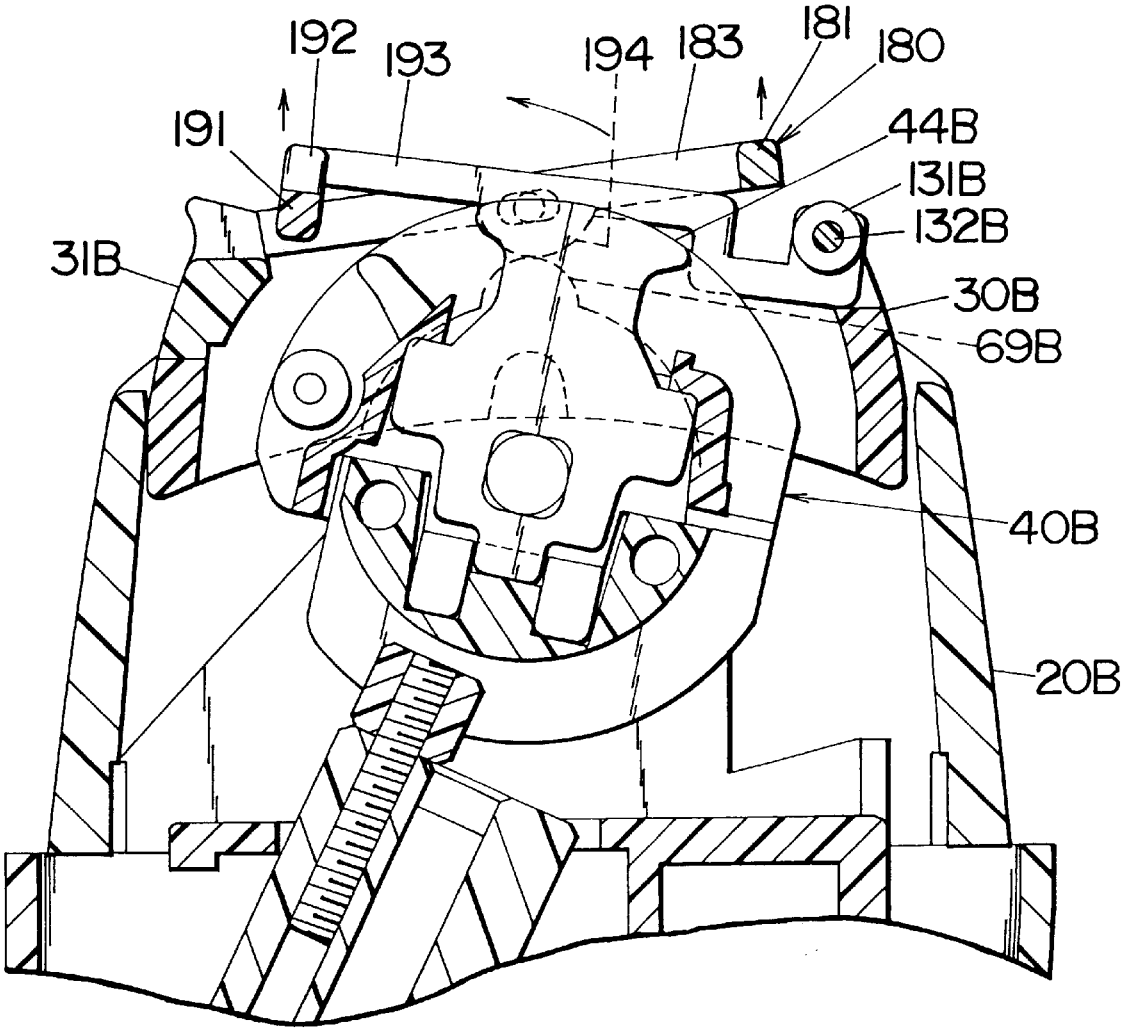
Figure 18B:
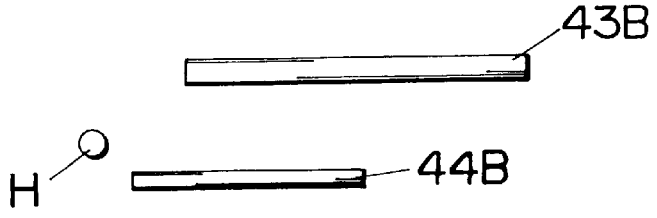

The depilating cycle of the plucking head 40B is now discussed in detail with reference to FIGS. 17 to 23. The depilating cycle is repeated during the operation of the device and consists of a hair introduction step of introducing the hairs between the adjacent pinching blades 43B and 44B, a hair pinching step of pinching the hair between the closing blades, a hair plucking step of plucking the hair from the skin, and a hair release step of releasing the plucked hairs from between the blades. In the hair introduction step, the plucking head 40B swing from a rear position where the edges of the movable blades 4B are held receded in the head 20B, as shown in FIG. 17A, to a projected position where the edges projects in the top of the device, as shown in FIG. 18A, during which the movable blade 44B are kept spaced from the associated fixed pinching blade 43B to be ready for introducing the hair H therebetween, as shown in FIGS. 17B and 18B. In the latter period of this step, the first and second stimulators 180 and 190 are caused to project, as shown in FIG. 18A, to stimulate the skin at portions opposite of a contact area of the plucking head with the skin.

Figure 19A:
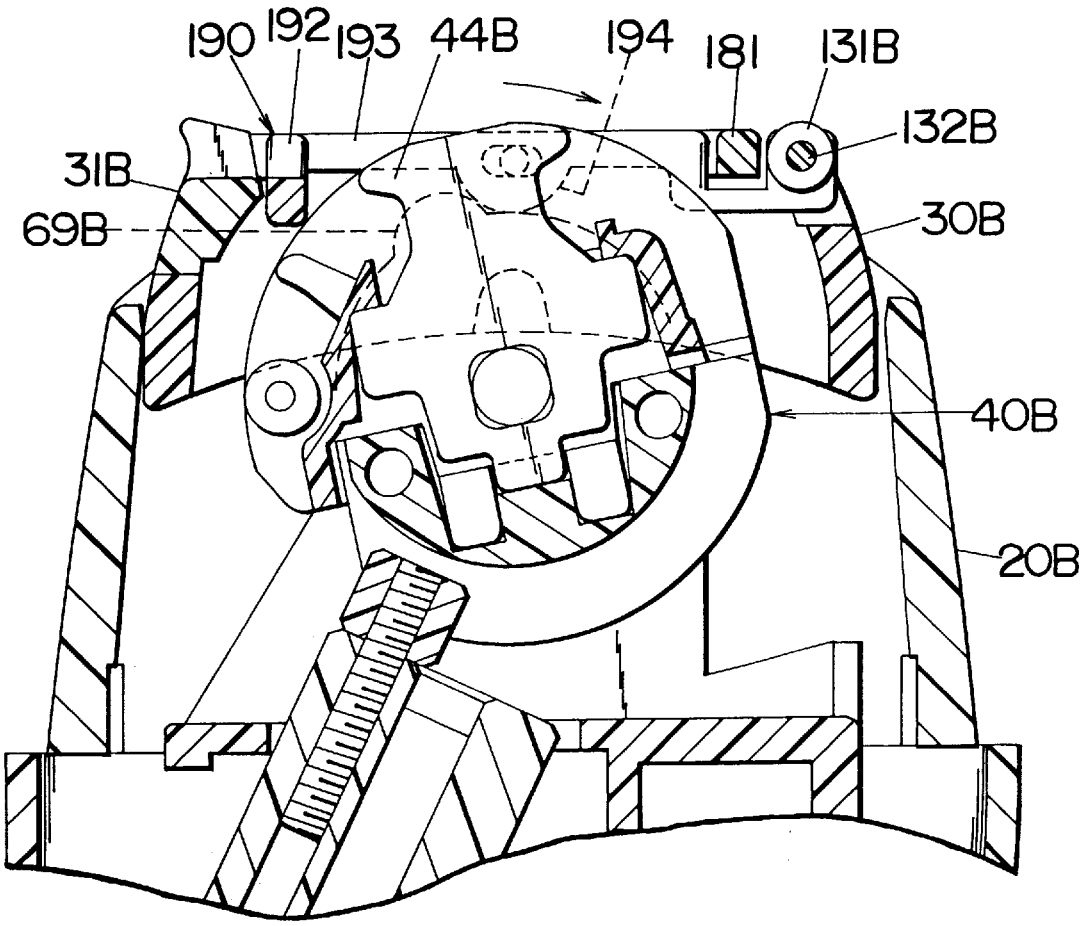
Figure 19B:
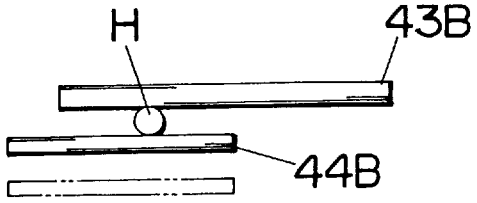

In the subsequent hair pinching step, the blade 44B and 43B are closed to pinch the hair H therebetween, as shown in FIG. 19B, at the same time the plucking head 40B reverses its rotating direction, as indicated by an arrow in FIG. 19A. In this step, the first and second stimulators 180 and 190 are kept inactivated not to stimulate the skin, enabling to grasp the hair by its root successfully for consistent hair plucking in the subsequent step. Further, it is noted that no stimuli in this step prior to the hair plucking is advantageous to avoid blurring to the stimuli, i.e., increasing of a threshold level of the sense receptors for optimum pain masking effect.

Figure 20A:
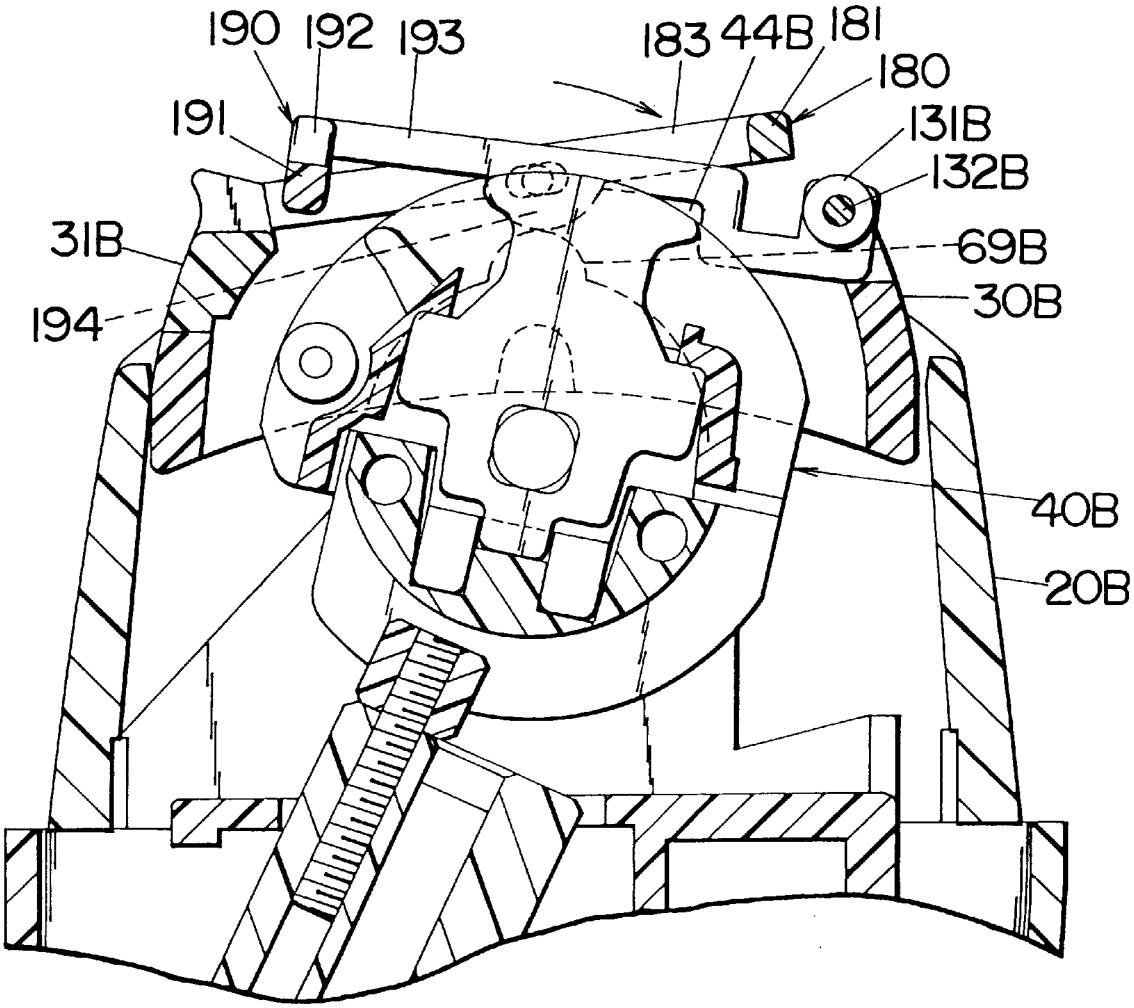
Figure 20B:
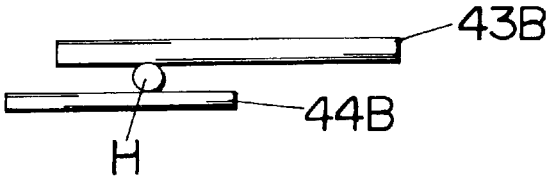
Figure 21A:
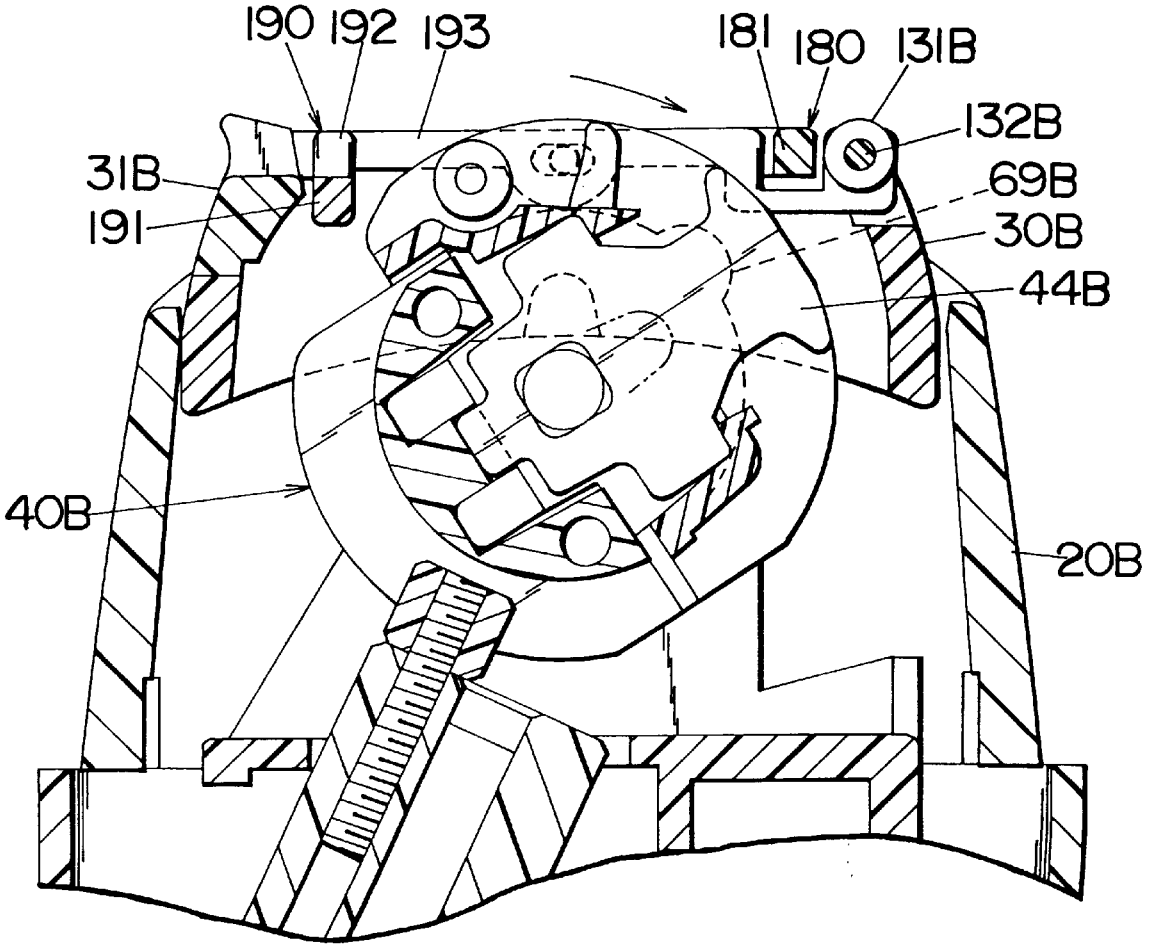
Figure 21B:
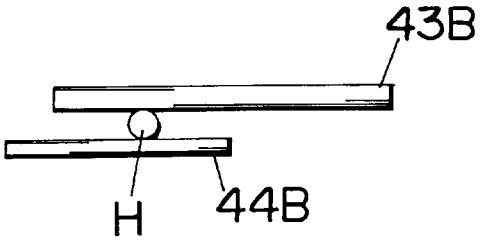

The hair plucking step starts to rotate the plucking head 40B in the same direction, as indicated by an arrow of FIG. 20A, while keeping the blades closed, as shown in FIG. 20B. At this occurrence, the first and second stimulators 180 and 190 are activated to stimulate the skin. Immediately thereafter, the plucking head 40B rotates further, as shown in FIG. 21A, while the hair H is kept between the blades, as shown in FIG. 21B, whereby the hair is plucked from the skin.

Figure 22A:
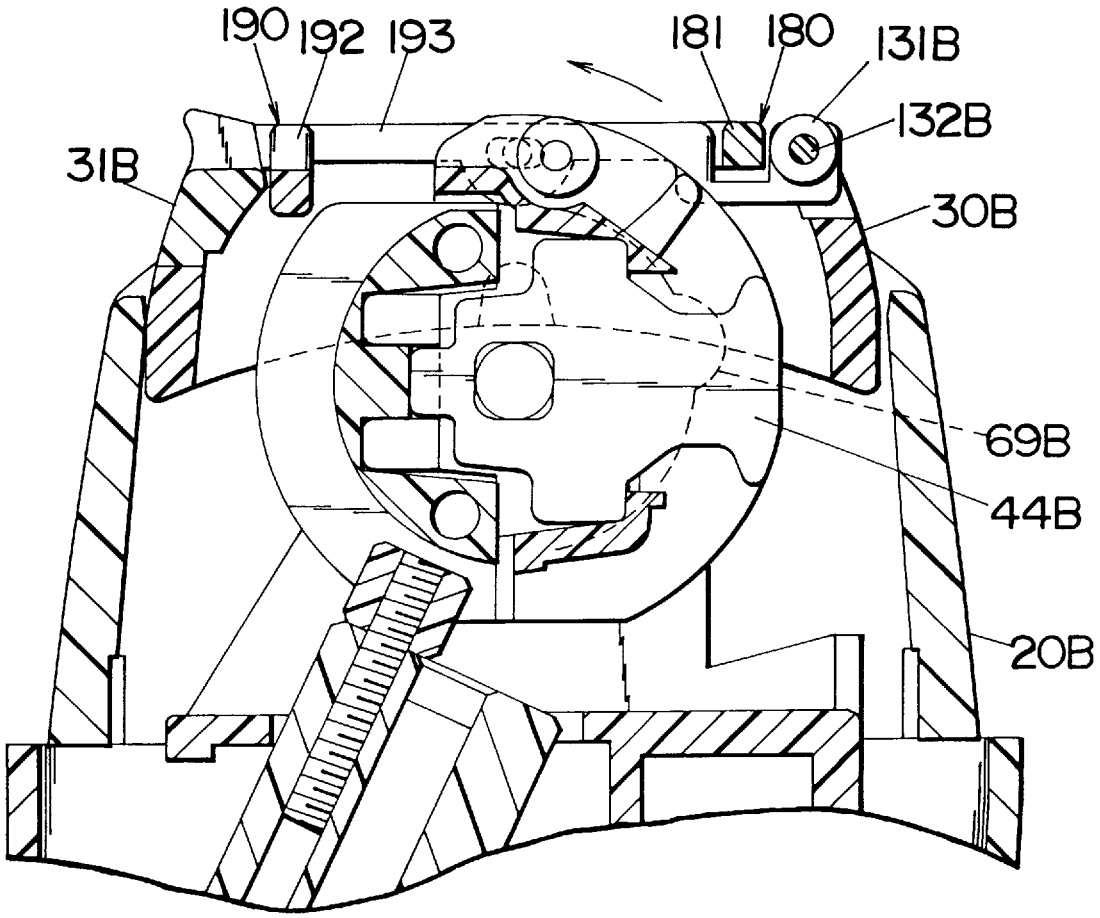
Figure 22B:
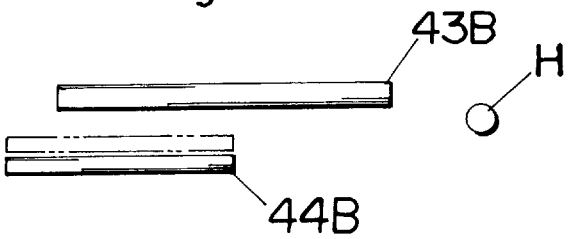

In the hair release step, the blades 43 and 44 are caused to open, as shown in FIG. 22B, releasing the plucked hair H, while the plucking head 40B rotates further to the innermost position where the edges of the blades retreat to a greatest extent from the top of the device, as shown in FIG. 22A, at which position the plucking head 40B reverses its rotating direction.

Figure 23:
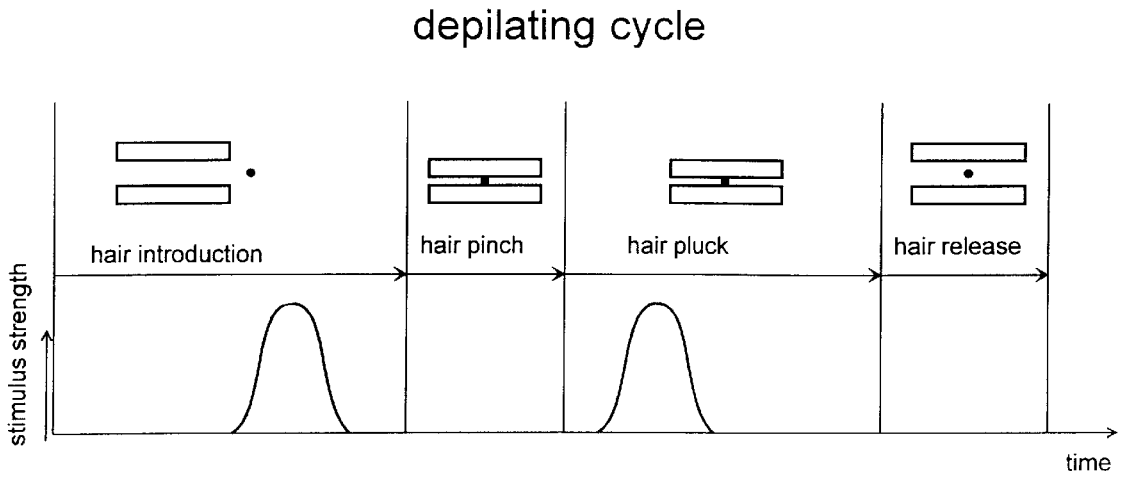
FIG. 23 is a schematic view illustrating a depilating cycle for the above device.

FIG. 23 illustrate the above explained depilating cycle in which the amount of the stimuli is shown in a waveform pattern. As seen in the figure, the stimuli is applied in the beginning of the plucking step to effectively mask the plucking pain and no stimuli is applied in the hair pinching step for facilitating to grasp the root of the hair. Further, the stimuli is applied in the end of the hair introduction step, adding the pain masking effect to the stimuli in the hair plucking step, yet leaving the skin free from the stimulus in the hair pinching step. The projection amount of the stimulators for stimulating the skin is set to be about 0.5 mm to 5.0 mm from a general contact surface of the plucking head to the skin, while the stimulators in the non-activated position, for example, in the hair pinching step is set to be kept away from the contact surface by a distance of about 0 to 0.3 mm.

Figure 24:
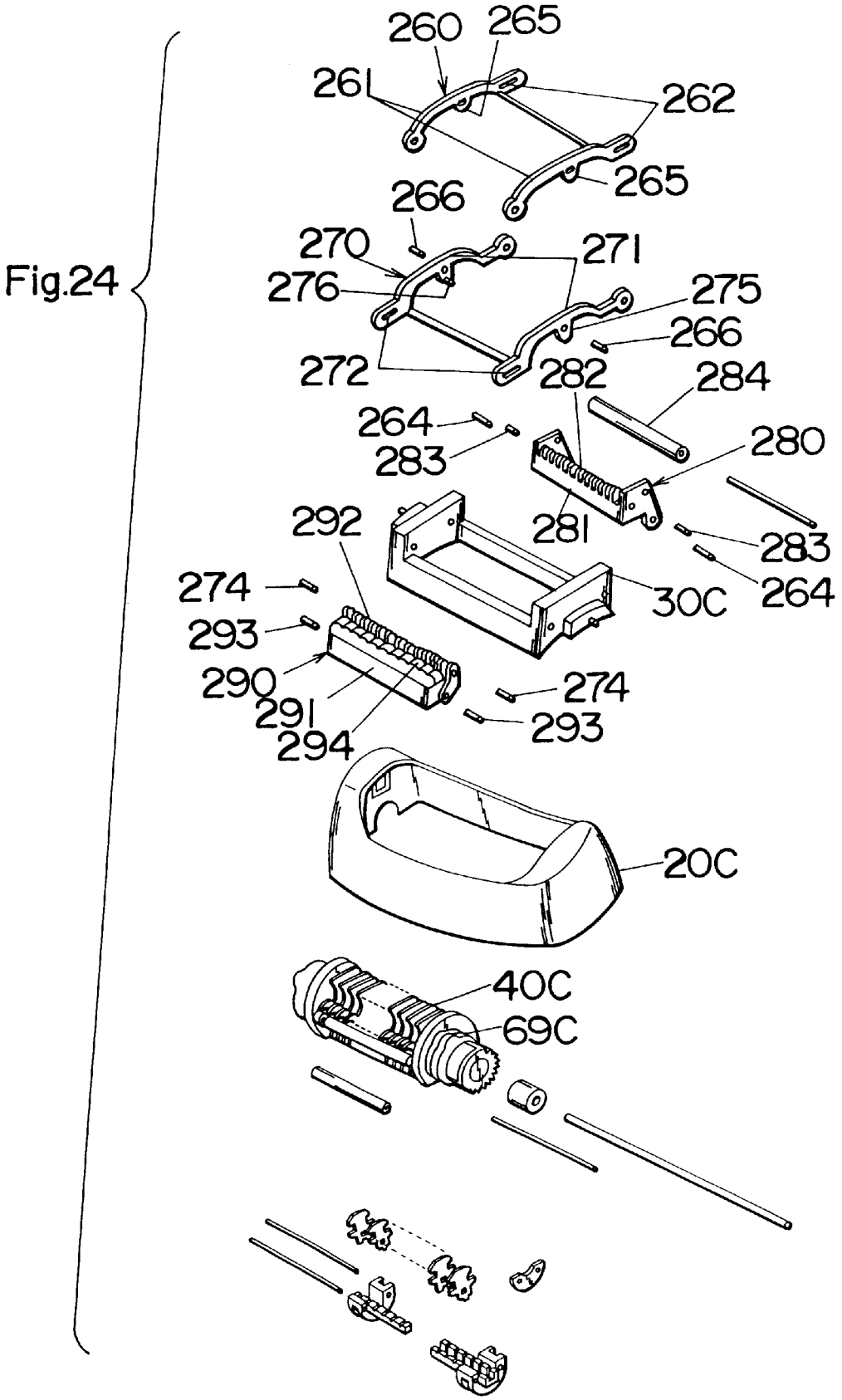
FIG. 24 is an exploded perspective view of a plucking head and an associated stimulator in accordance with a fourth embodiment of the present invention.

Fourth Embodiment <FIGS. 24 to 26>

A depilating device in accordance with a fourth embodiment of the present invention is similar in structure and in operation to the third embodiment except that first and second stimulators 280 and 290 are provided to act also as skin stretcher, respectively for stretching portions of the skin on opposite sides of the plucking head 40C. The plucking head 40C and the driving mechanism thereof are identical to those of the third embodiment and therefore are not repeated here. Like parts are designated by like numerals with like numerals with a suffix letter of "C". The first and second stimulators are mounted on a guide frame 30C which is supported to a head frame 20C in a like manner as explained in the first embodiment so as to be capable of swinging about a horizontal axis as well as being depressed together with the plucking head 40C relative to the head frame 20C.

Figure 25A:
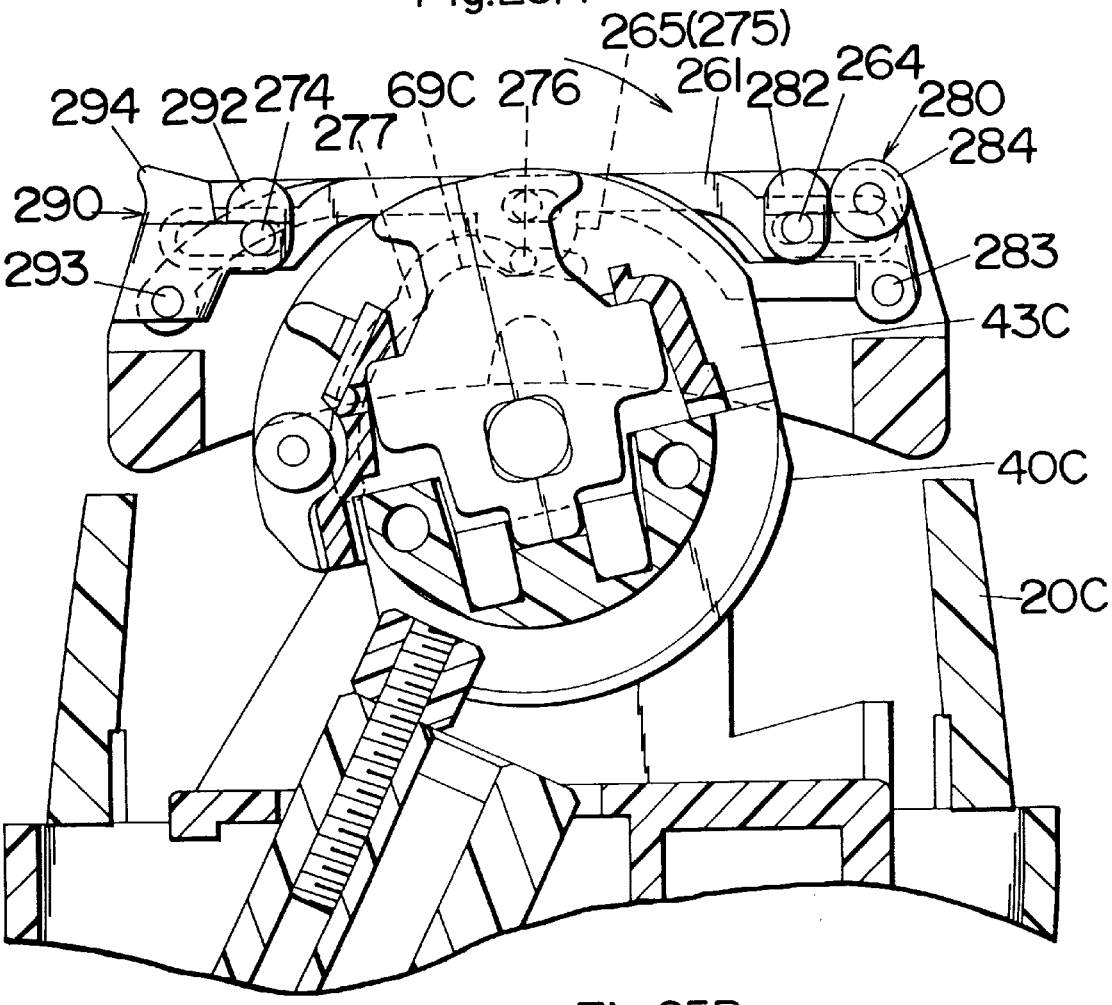
FIGS. 25A and 26A are sectional views illustrating in sequence operations of the plucking head and the stimulator.
Figure 26A:
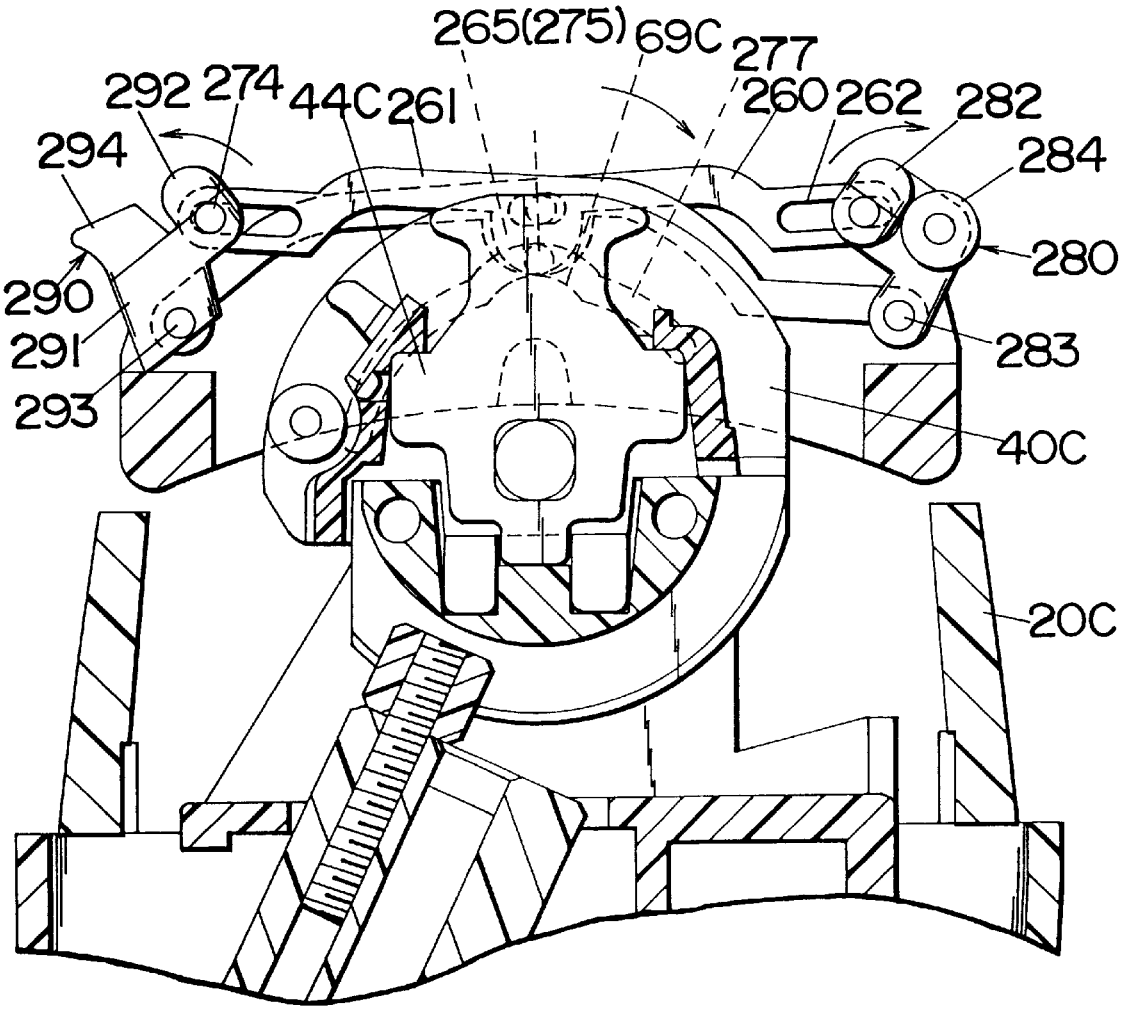

As shown in FIG. 24, the first stimulator 280 comprises a series of first comb teeth 282 arranged on a first base 281 which extends in parallel with the plucking head 40C and is pivotally supported to the rear of the guide frame 30C by means of a pivot pin 283. A freely rotating roller 284 is supported to the base immediately behind the first comb teeth 282 in a parallel relation thereto. The second stimulator 290 comprises a series of second comb teeth 292 arranged on a second base 291 which extends in parallel with the plucking head 40C and is pivotally supported to the front of the guide frame 30C by means of a pivot pin 293. The second base 291 is formed with a series of rounded comb projections 294 arranged in parallel with the second comb teeth and forwardly thereof. The first and second stimulators 280 and 290 are thus capable of swinging about respective axes of the pivot pins 283 and 293 between a rest position of lying the upper ends of the stimulators approximately in level with the upper end of the plucking head 40C, as shown in FIG. 25A, and an extended position of projecting the first and second comb teeth 282 and 292, as shown in FIG. 26A.

The above swinging movement is accomplished by means of first and second linkages 260 and 270 respectively connecting the first and second stimulators 280 and 290 commonly to the carrier 41C of the plucking head 40C. Turning back to FIG. 24, the first linkage 260 comprises a pair of arms 261 pivotally supported at its front end to the guide frame 30C by the use of the pivot pin 293. The arms 261 are formed in their rear ends with elongated slots 262 into which link pins 264 extend for connection of the rear end of the first linkage 260 to the first stimulator 280 at a portion offset from the pivot pin 283. Likewise, the second linkage 270 comprises a pair of arms 271 pivotally supported at its rear end to the guide frame 30C by the use of the pivot pin 283. The arms 271 are formed in their front ends with elongated slots 272 into which link pins 274 extend for connection of the front end of the second linkage 270 to the second stimulator 290 at a portion offset from the pivot pin 293. The arms 261 and 271 are each formed at its middle with each of cam follower projections 265 and 275 engaged with cam wheels 69C formed on the carrier 41C of the plucking head 40C. The cam follower projections 265 and 275 are interconnected by means of pins 266. Projecting inwardly from the cam follower projections 275 of the second linkage 270 are guide pins 276 which extend respectively into corresponding grooves 277.

Figure 25B:
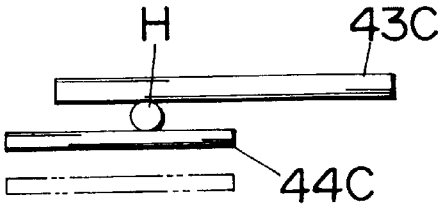
FIGS. 25B and 26B correspond respectively to FIGS. 25A and 26A and illustrate the relation between two adjacent pinching blades and a hair to be introduced and plucked thereby.
Figure 26B:
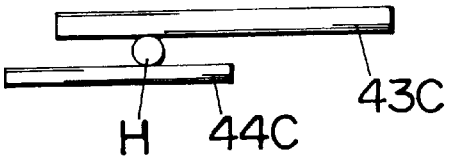

In this manner, the first and second stimulators 280 and 290 are drivingly connected to the carrier 41C of the plucking head 40C so as to give the skin stretching stimuli in synchronism with the depilating cycle in a like manner as discussed in the third embodiment with reference to FIG. 23. As shown in FIGS. 25A and 25B, the first and second stimulators 280 and 290 are kept in the rest position of applying no stretching stimuli when the plucking head 40C is in the step of pinching the hair H between the blades 43C and 44C. When the plucking head 40C comes into the hair plucking step as shown in FIG. 26A and 26B, the first and second stimulators 280 and 290 are caused to move into the projected position of giving the skin stretching stimuli. It is noted here that when the first and second stimulators are in the rest position of FIG. 25A, the adjacent elements, i.e., the roller 284 and the 294 at rear and front ends of the frame 30C come into contact with the skin for guiding the device smoothly as well as raising the flattened hairs to be subsequently plucked. The projection amount of the stimulators is set to be about 0.5 mm to 5.0 mm from a general contact surface of the plucking head to the skin, while the stimulators in the rest position is set to be kept away from the contact surface by a distance of about 0 to 0.3 mm. In this embodiment, the stimuli are applied at the frequency of 10 to 400 Hz. It should be noted that the timing of applying the stimuli is not limited to that shown in FIG. 23 and may be suitably selected in order to realize an optimum effect of masking the hair plucking pain. A suitable bias mechanism may be included to bias the first and second stimulators 280 and 290 towards the rest position of applying no stimuli.

Figure 28:
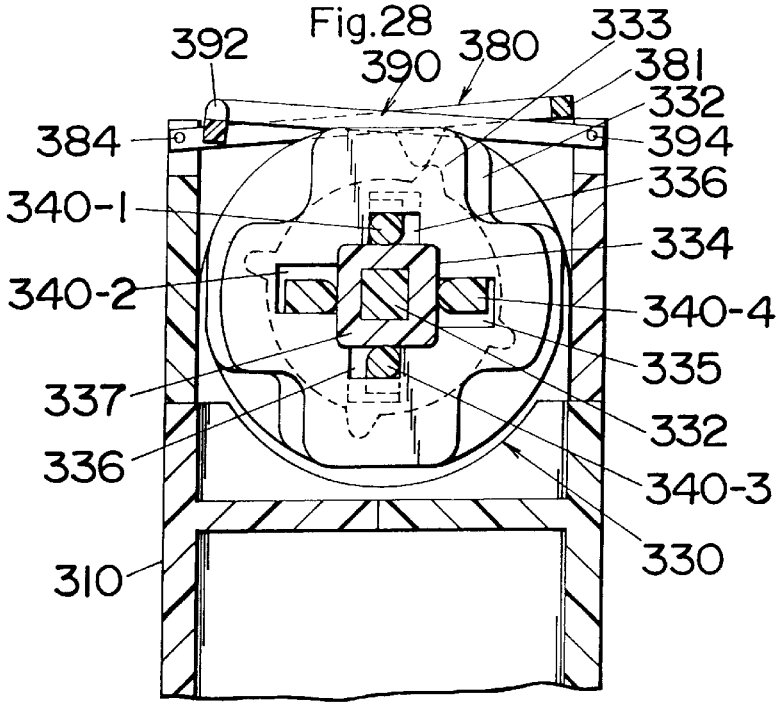
FIG. 28 is a side section of a plucking head with a stimulator utilized in the above device.
Figure 29:
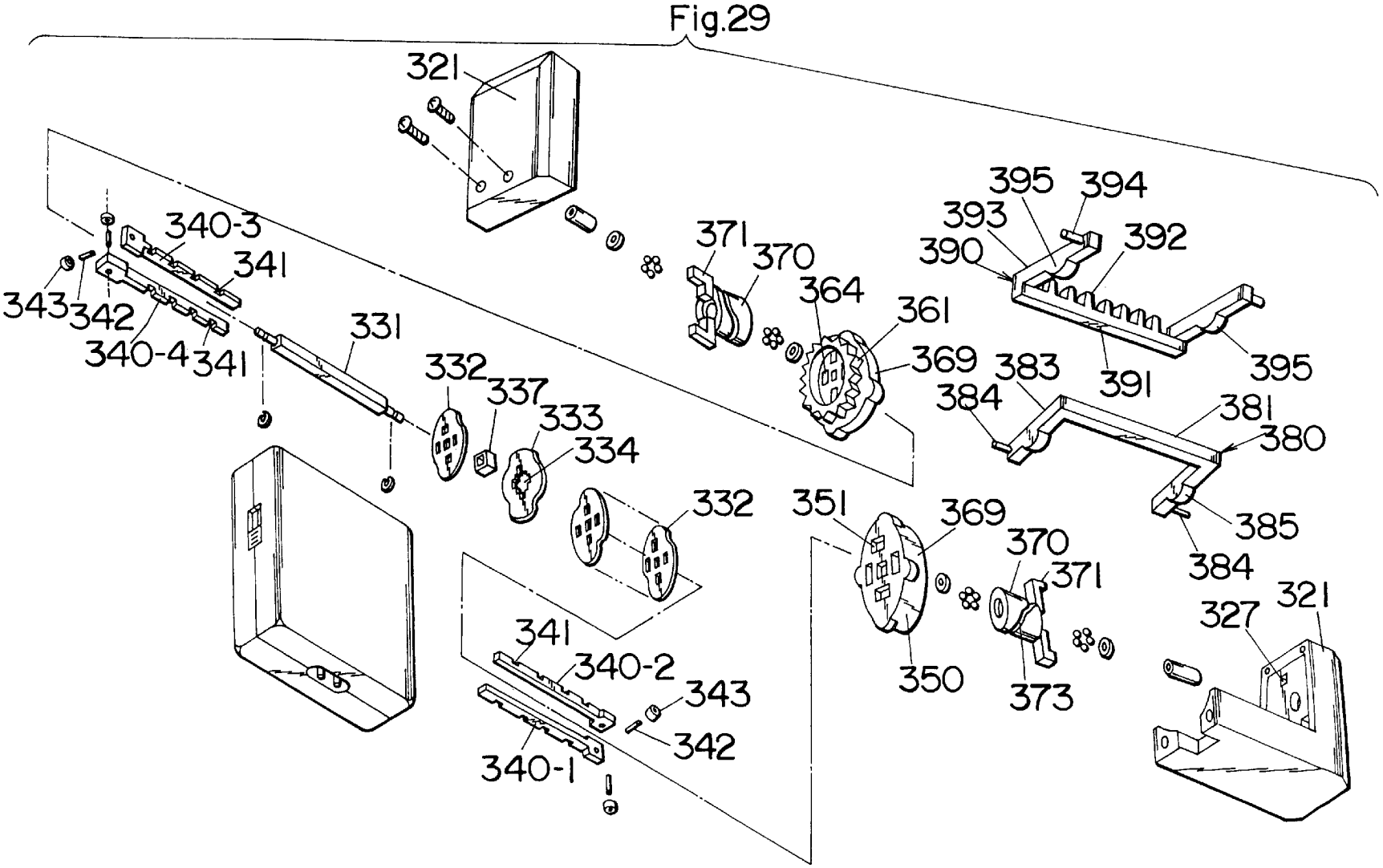
FIG. 29 is an exploded perspective view illustrating a plucking head of the above device.
Figure 30:
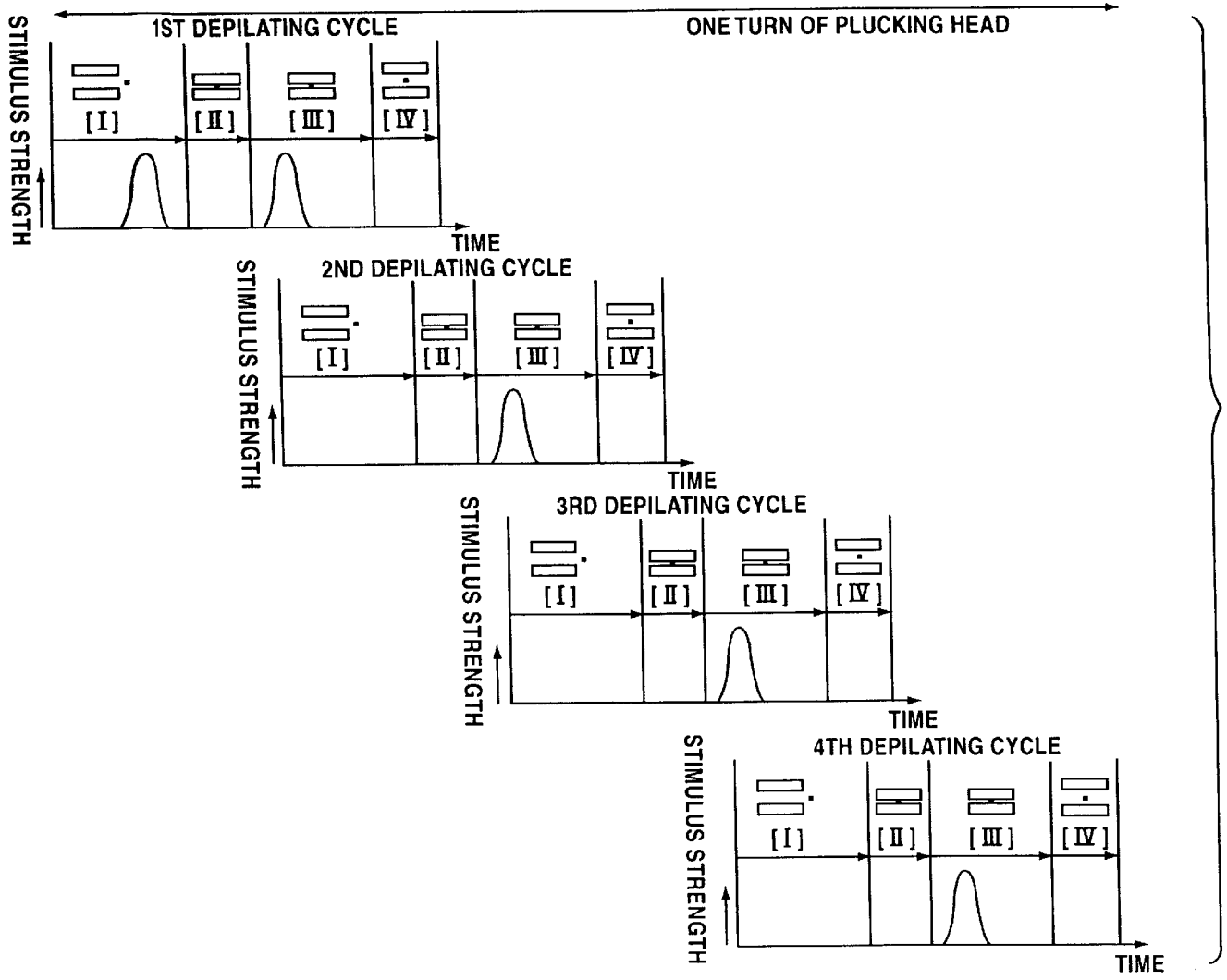
FIG. 30 is a schematic view illustrating a depilating cycle for the above device.

Fifth Embodiment <FIGS. 28 to 30>

A depilating device in accordance with the fifth embodiment is designed to have a plucking head 330 of the type which rotates in one direction and performs the depilating cycles 4 (four) times per one rotation of the head 330. For this purpose, the plucking head 330 includes disk-shaped fixed pinching blades 332 and two sets of disk-shaped movable pinching blades 333 each having diametrically opposed edges for pinching the hairs against the corresponding edges of the adjacent fixed pinching blade 332, as will be discussed in detail hereinafter.

As is similar with the previous embodiments, the depilating cycle consists of hair introducing step [I], hair pinching step [II], hair plucking step [III], and hair releasing step [IV]. The stimuli is applied in the hair plucking step [III] of pinching the hair in each depilating cycle as shown in FIG. 30. The hair plucking step [III] of one depilating cycle is concurrent with the hair introducing step [II] of the subsequent depilating cycle.

Figure 27:
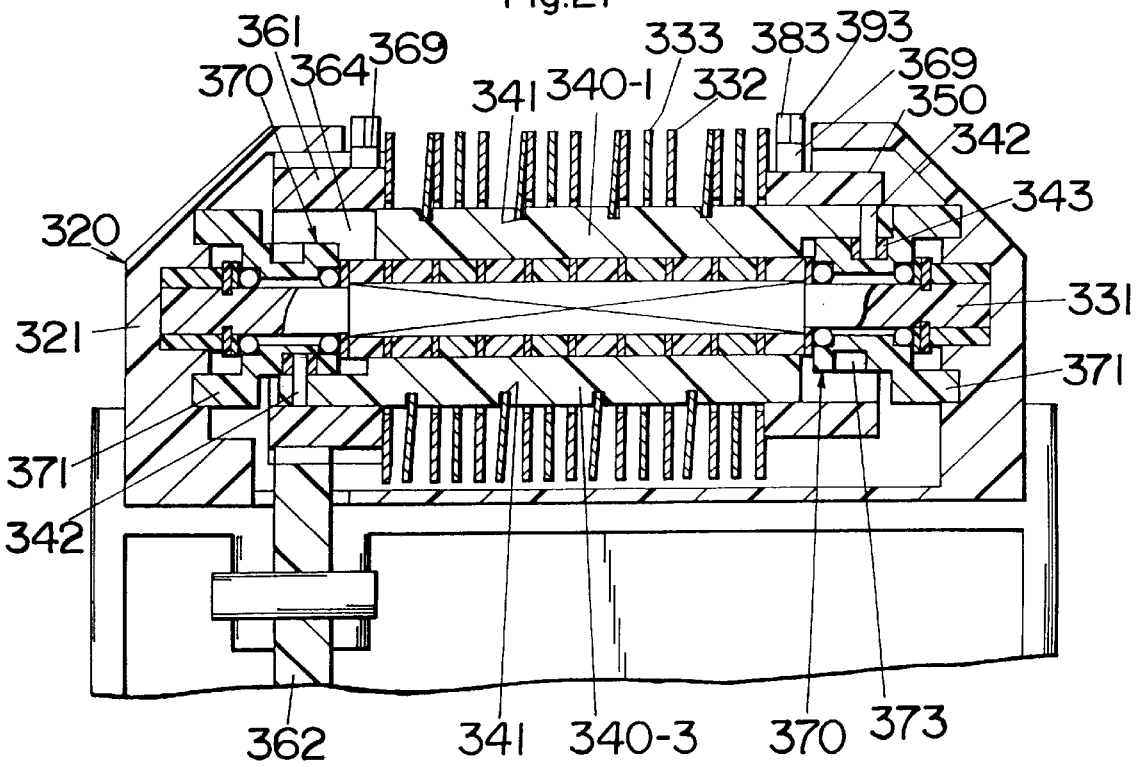
FIG. 27 is a front vertical section of a depilating device in accordance with a fifth embodiment of the present invention.

As shown in FIGS. 27 and 29, the device comprises a housing 310 which mounts thereon a head frame 320 carrying the plucking head 330 and incorporates a motor (not shown) for rotating the plucking head 330 while closing and opening the blades 332 and 333. The head frame 320 comprises a pair of end walls 321 which define therebetween an opening 323. The plucking head 330 comprises a rotary shaft 331 extending horizontally between the end walls 321 with its opposite ends rotatably supported to the end walls 321. A reduction gear 361 is fitted on one end of the square cross-sectional portion of the shaft 331 to be rotatable together therewith, and is in meshing engagement through an intermediate gear 362 with a drive gear of the motor so that the shaft 331 is driven to rotate in one direction about a horizontal axis. The shaft 331 carries a series of axially spaced fixed and movable pinching blade 332 and 333 both rotatable together with the shaft 331. The fixed and movable blades 332 and 333 are arranged to alternate in the axial direction with fixed blades 332 on the opposite ends of shaft 331 such that fixed blades 332 are fixed in the axial direction and movable blades 333 is allowed to shift in that direction. The fixed blades 332, each formed in its center with a square hole for tightly receiving the square portion of the shaft 331, are axially spaced at a regular interval to one another by means of square-shaped collar 337. Movable blades 333 are each formed in its center with a relatively large square hole 334 in which collar 337 is loosely engaged such that movable blades 333 are rotatable together with the shaft 331 and also shiftable in the axial direction in an inclined relation with respect to the shaft axis.

A set of four shuttle levers 340-1 to 340-4 extend in parallel with shaft 331 and are circumferentially spaced at an angular interval of 90° about shaft 331. Each lever 340 is supported with its opposite ends slidably received respectively in one of axial bores 364 of the gear 361 and in one of axial bores 351 in a support ring 350 which is fitted on the axial end of the square cross-sectional portion of shaft 331 to be rotatable together therewith. Each of the levers 340-1 to 340-4 penetrates through fixed and movable blades 332 and 333 in such a manner as to engage each alternate movable blade 333 for displacing it along the axial direction when the lever reciprocates along the shaft 331, as will be discussed later. To this end, each lever 340 is formed along its length with a plurality of notches 341 for connection with each alternate movable blade 333. As shown in FIG. 28, each movable blade 333 is formed with four slots circumferentially spaced by 90° about the center hole 334. Two slots 335 in a diametrically opposed pair extend radially by a greater extent than the other two slots 336 in the other diametrically opposed pair, such that the lever 340 can freely pass through the long slots 335 but engages at the individual notches 341 with the radial outer edges of the short slots 336 so as to displace thus engaged movable blades 333 as the lever is driven to reciprocate along the shaft 331. Each of the levers 340-1 to 340-4 penetrates loosely through corresponding slots in fixed blades 332 and is allowed to reciprocate independently of the fixed blades 332. The levers 340-1 and 340-3 in one diametrically opposed pair are engaged with one set of movable blades 333, while levers 340-2 and 340-3 in the other pair are engaged with the other set of movable blades 333 which alternate with the one set of movable blades.

Each of levers 340-1 to 340-4 carries at its one end a pin 342 with a roller 343 for connection with one of positive-return cams 370 which are fitted around the opposite ends of the shaft 331 and held stationary with anchor legs 371 of each cam 370 loosely engaged into corresponding dents 327 in the end walls 321. Each cam 370 is in the form of a cylinder with a groove 373 for guiding engagement with the roller 343 at the end of the lever 340 such that the lever 340 is driven by cam 370 to shift along the shaft 331 as the lever rotates together with the shaft 331. In this manner, as the plunking head 330 rotates about the shaft axis, levers 340-1 to 340-2 are driven by cams 370 to reciprocate for displacing the movable blades 333 against the adjacent fixed blades 332 to repeat closing the one circumferential edge of the movable blade 333 to the corresponding edge of the fixed blade 332. Whereby, the plucking head 330 operates to perform the above depilating cycle of introducing the hairs between the blades (step [I]), pinching the hair therebetween (step [II]), plucking the hairs (step [III]), and releasing the same (step [IV]).

The grooves 373 of cams 370 are configured to be symmetrical with one another such that the levers 340 rotating to reach the top end of the head 330 are shifted horizontally outwardly and the levers 340 rotating to reach the lower end are shifted horizontally inwardly. Thus, the levers 340 are caused to reciprocate one stroke along the shaft axis per one rotation thereabout. The diametrically opposed levers 340-1 and 340-3 [340-2 and 340-4] engaged with the same set of movable blades 333 are linked to the different cams 370 such that the blades 333 commonly engaged with the two diametrically opposed levers are shifted in the opposite directions between the two adjacent fixed blades 332 per 180° rotation of the levers 340 about the shaft axis. This means that movable blade 333, which have been in close edge contact with one of the adjacent fixed blades 332, is shifted to move away therefrom and come into close edge contact with the other adjacent fixed blades every after 180° rotation of the shaft 331. The hairs pinched between the blades 332 and 333 as shown in FIG. 28 are plucked from the skin as the blades rotate further. Thereafter, the plucked hairs are released from between the blades 332.

The head frame 320 carries first and second stimulators 380 and 390 each of generally U-shaped configuration. The first stimulator 380 comprises a first bar 381 defining a rear stimulator element of applying stimuli to the skin behind the plucking head 330. A pair of arms 383 extend forward from the opposite ends of the bar and are pivotally connected at their front ends to the front upper end of the head frame 320 by means of a pivot pin 384. Likewise, the second stimulator 390 comprises a second bar 391 with a series of comb projections 392 which define front stimulator element of applying stimuli to the skin forwardly of the plucking head. A pair of arms 393 extend rearward from the opposite ends of the bar and are pivotally connected at their rear ends to the rear upper end of the head frame 320 by means of a pivot pin 394. The arms 383 and 393 are formed intermediate their length respectively with cam follower projections 385 and 395 engageable with cam wheels 369 formed on opposite ends of the shaft 331 as integral parts of the support ring 350 and the reduction gear 361. Thus, as the plucking head 330 rotates, the cam wheels 369 rotate to periodically engage teeth 368 with the cam follower projections 385 and 395, thereby moving up and down the stimulator elements 381 and 392 for stimulation of the skin. The pitch of the teeth on the cam wheel 369 is set to be about 90° to apply the stimuli in synchronize with the depilating cycle as shown in FIG. 30. A bias mechanism may be included to bias the first and second stimulators 380 and 390 towards rest position of applying no stimuli.

What is claimed is:

1. A hand-held depilating device for plucking hairs from the skin of a user, said depilating device comprising:

a housing adapted to be grasped by the hand of the user;

a plucking head mounted on top of said housing for plucking the hairs from the skin, said plucking head comprising a plurality of pinching elements arranged along an axis in a closely adjacent relation to form therebetween gaps for entrapping the hairs therein, at least one pinching element of said plurality of pinching elements being driven to move relative to a remainder of said plurality of pinching elements in a direction of successively opening and closing said gaps so as to pinch the hairs between said plurality of pinching elements which are adjacent each other and release the hairs therefrom;

cycler means for cyclicly moving said plucking head about said axis of said plucking head to define, in combination with a movement of closing and opening said gaps, repeated depilating cycles of introducing the hairs between said plurality of pinching elements which are adjacent each other, pinching the hairs therebetween, plucking the hairs from the skin, and releasing the hairs from between said plurality of pinching elements which are adjacent each other;

stimulator means mounted on top of said housing adjacent to said plucking head for applying stimuli to the skin separately from said plurality of pinching elements which are adjacent each other;

wherein said depilating device includes a synchronous mechanism for synchronizing a timing of applying said stimuli with said depilating cycle;

wherein said cycler means operates to rotate said plucking head about said axis for achieving said depilating cycle, and said synchronous mechanism comprises a cam mounted on said plucking head to be rotatable therewith, and a cam follower which is engageable with said cam and connected to said stimulator means for applying said stimuli in synchronism with a rotation of said plucking head;

wherein said stimulator means comprises a movable member having a first end, which is a pivot end, pivotally supported on said top of said housing and having a stimulator element at a second end; and wherein said cam follower is formed on said movable member at a middle portion between said pivot end and said second end provided with said stimulator element.

2. A hand-held depilating device for plucking hairs from the skin of a user, said depilating device comprising:

a housing adapted to be grasped by the hand of the user;

a plucking head mounted on top of said housing for plucking the hairs from the skin, said plucking head comprising a plurality of pinching elements arranged along an axis in a closely adjacent relation to form therebetween gaps for entrapping the hairs therein, at least one pinching element of said plurality of pinching elements being driven to move relative to a remainder of said plurality of pinching elements in a direction of successively opening and closing said gaps so as to pinch the hairs between said plurality of pinching elements which are adjacent each other and release the hairs therefrom;

cycler means for cyclicly moving said plucking head about said axis of said plucking head to define, in combination with a movement of closing and opening said gaps, repeated depilating cycles of introducing the hairs between said plurality of pinching elements which are adjacent each other, pinching the hairs therebetween, plucking the hairs from the skin, and releasing the hairs from between said plurality of pinching elements which are adjacent each other;

stimulator means mounted on top of said housing adjacent to said plucking head for applying stimuli to the skin separately from said plurality of pinching elements which are adjacent each other;

wherein said depilating device includes a synchronous mechanism for synchronizing a timing of applying said stimuli with said depilating cycle; and wherein said cycler means operates to rotate said plucking head about said axis for achieving said depilating cycle, and said synchronous mechanism comprises a cam mounted on said plucking head to be rotatable therewith, and a cam follower which is engageable with said cam and connected to said stimulator means for applying said stimuli in synchronism with a rotation of said plucking head.

3. The depilating device as set forth in claim 2, wherein said stimulator means comprises a movable member having a first end, which is a pivot end, pivotally supported on said top of said housing and having a stimulator element at a second end.

4. The depilating device as set forth in claim 3, wherein said stimulator means comprises a skin stretcher which develops a stimulus of applying a force of stretching the skin as one of said stimuli, said skin stretcher being pivotally supported at a lower part of the pivot end thereof on said top of said housing and is driven to swing about said pivot end in a direction of moving towards and away from said plucking head.

5. The depilating device as set forth in claim 4, wherein said skin stretcher and a second skin stretcher are disposed on opposite sides of said plucking head and are driven to swing towards and away from each other.

6. The depilating device as set forth in claim 4, wherein said skin stretcher is connected to a drive arm to be driven thereby to swing about said pivot end, said drive arm being pivotally supported at a first end of said drive arm on said top of said housing opposite of said plucking head from said skin stretcher to pivot about said first end of said drive arm, said drive arm being connected at a second end thereof which is opposite of said first end of said drive arm by means of a link to said skin stretcher at a portion offset from said pivot axis so that a pivotal movement of said drive arm causes said skin stretcher to swing about said pivot axis.

7. The depilating device as set forth in claim 3, wherein said cam follower is formed on said movable member at a middle portion between said pivot end and said second end provided with said stimulator element.

8. The depilating device as set forth in claim 2, wherein said stimulator means comprises a vibrator which develops a stimulus of applying vibrations to the skin as one of said stimuli.

9. The depilating device as set forth in claim 2, wherein said stimulator means comprises a skin stretcher which develops a stimulus of applying a force of stretching the skin as one of said stimulus.

10. The depilating device as set forth in claim 9, wherein said skin stretcher acts to stretch the skin when driven to swing in a direction away from said plucking head while said plucking head acts to pluck the hairs from the skin.

11. The depilating device as set forth in claim 2, wherein said synchronous mechanism is arranged to apply said stimuli to the skin at least while said plucking head acts to pluck the hairs from the skin.

12. The depilating device as set forth in claim 11, wherein said synchronous mechanism is arranged to apply said stimuli to the skin at a beginning of plucking the hairs by said plucking head.

13. The depilating device as set forth in claim 2, wherein said synchronous mechanism is arranged so as not to apply said stimuli to the skin while said plucking head acts to pinch the hairs between said plurality of pinching elements which are adjacent to each other.

14. The depilating device as set forth in claim 2, wherein said synchronous mechanism is arranged to apply said stimuli to the skin at least while said plucking head acts to introduce the hairs between said plurality of pinching elements which are adjacent to each other.

15. The depilating device as set forth in claim 14, wherein said synchronous mechanism is arranged to apply said stimuli to the skin at an end of introducing the hairs between said plurality of pinching elements which are adjacent to each other.

16. The depilating device as set forth in claim 2, wherein said stimulator means comprises a plurality of stimulator elements acting simultaneously to apply said stimuli.

* * * * *